US011462147B2

(12) United States Patent
Gao et al.

(10) Patent No.: US 11,462,147 B2
(45) Date of Patent: Oct. 4, 2022

(54) DISPLAY PANEL AND ELECTRONIC DEVICE

(71) Applicant: SHENZHEN CHINA STAR OPTOELECTRONICS SEMICONDUCTOR TECHNOLOGY CO., LTD., Guangdong (CN)

(72) Inventors: Yanan Gao, Guangdong (CN); Ligon Kim, Guangdong (CN); Bin Zhao, Guangdong (CN); Xin Zhang, Guangdong (CN); Jun Zhao, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 222 days.

(21) Appl. No.: 16/770,585

(22) PCT Filed: Apr. 30, 2020

(86) PCT No.: PCT/CN2020/088082

§ 371 (c)(1),
(2) Date: Jun. 5, 2020

(87) PCT Pub. No.: WO2021/189597

PCT Pub. Date: Sep. 30, 2021

(65) Prior Publication Data

US 2022/0114941 A1 Apr. 14, 2022

(30) Foreign Application Priority Data

Mar. 22, 2020 (CN) ..... 202010204835.4

(51) Int. Cl.
*G09G 3/3266* (2016.01)
*G09G 3/20* (2006.01)

(52) U.S. Cl.
CPC ... *G09G 3/2092* (2013.01); *G09G 2310/0267* (2013.01)

(58) Field of Classification Search
CPC ..... G09G 3/2092; G09G 2310/0267; G09G 2300/0408; G09G 2300/0426; G09G 3/3677; G09G 3/20
See application file for complete search history.

(56) References Cited

U.S. PATENT DOCUMENTS

2012/0168762 A1 7/2012 Kikuchi et al.
2015/0379951 A1 12/2015 Zeng
(Continued)

FOREIGN PATENT DOCUMENTS

CN 102483889 A 5/2012
CN 103745707 A 4/2014
(Continued)

*Primary Examiner* — Jose R Soto Lopez
(74) *Attorney, Agent, or Firm* — Dickinson Wright PLLC

(57) ABSTRACT

A display panel and an electronic device is provided. A voltage drop value of the clock input transistor of a pull-up module of m1$^{st}$ GOA unit connected to an n1$^{st}$ clock signal line is greater than a voltage drop value of the clock input transistor of a pull-up module of m2$^{nd}$ GOA unit connected to the n2$^{nd}$ clock signal line. Based on this circuit structure, a CK impedance difference existing in 8K ultra-high resolution electronic devices can be alleviated.

18 Claims, 13 Drawing Sheets

(56) References Cited

U.S. PATENT DOCUMENTS

| | | | | |
|---|---|---|---|---|
| 2016/0260403 | A1* | 9/2016 | Dai | G09G 3/3677 |
| 2016/0260405 | A1* | 9/2016 | Dai | G09G 3/3677 |
| 2016/0275895 | A1* | 9/2016 | Dai | G09G 3/36 |
| 2016/0284303 | A1* | 9/2016 | Dai | G09G 3/3677 |
| 2016/0284304 | A1* | 9/2016 | Dai | G09G 3/3677 |
| 2017/0200420 | A1 | 7/2017 | No et al. | |
| 2017/0309243 | A1* | 10/2017 | He | G09G 3/3648 |
| 2018/0190233 | A1* | 7/2018 | Jang | G09G 3/3677 |
| 2018/0336834 | A1* | 11/2018 | Liu | G09G 3/34 |
| 2018/0336857 | A1* | 11/2018 | Shi | G09G 3/3674 |
| 2018/0337682 | A1 | 11/2018 | Takasugi et al. | |
| 2019/0019469 | A1* | 1/2019 | Lv | G09G 3/3677 |
| 2019/0019470 | A1* | 1/2019 | Zeng | G09G 3/20 |
| 2019/0019471 | A1* | 1/2019 | Zeng | G11C 19/28 |
| 2019/0103049 | A1 | 4/2019 | Noh et al. | |
| 2019/0311689 | A1 | 10/2019 | Takahashi | |
| 2019/0333433 | A1* | 10/2019 | Zhu | G11C 19/28 |
| 2020/0051499 | A1 | 2/2020 | Chung et al. | |
| 2020/0168162 | A1 | 5/2020 | Feng et al. | |
| 2021/0201803 | A1* | 7/2021 | Feng | G09G 3/3225 |
| 2021/0210154 | A1* | 7/2021 | Feng | G11C 19/28 |
| 2021/0280147 | A1* | 9/2021 | Xi | G11C 19/28 |

FOREIGN PATENT DOCUMENTS

| | | | |
|---|---|---|---|
| CN | 106991949 | A | 7/2017 |
| CN | 108932930 | A | 12/2018 |
| CN | 109119039 | A | 1/2019 |
| CN | 109243392 | A | 1/2019 |
| CN | 109584805 | A | 4/2019 |
| CN | 109584809 | A | 4/2019 |
| CN | 109935185 | A | 6/2019 |
| CN | 109935188 | A | 6/2019 |
| CN | 109935209 | A | 6/2019 |
| CN | 110024021 | A | 7/2019 |
| EP | 3608899 | A1 | 2/2020 |
| KR | 20150078898 | A | 7/2015 |
| KR | 20180051910 | A | 5/2018 |

* cited by examiner

DISPLAY PANEL AND ELECTRONIC DEVICE

FIELD OF INVENTION

The present disclosure relates to the field of display technology, and more particularly, to a display panel and an electronic device.

BACKGROUND OF INVENTION

With the developments in display technology, the resolution of electronic devices such as display screens, TVs, and mobile phones have become higher and higher, with an increase in resolution corresponding to an increase in the number of pixels, which accompanies a plurality of technical challenges.

For example, 8K ultra-high resolution electronic devices have heavy loading (short voltage drop) and short charging time. Due to adoption of GOA circuits (Gate on Array, gate drive circuit integrated on the array substrate) and a thick copper design, this results in an extreme sensitivity to impedance differences between CK (clock) signals of ultra-high resolution electronic devices and the GOA circuits. The resolution of an 8K electronic device is 7680*4320, there are a total of 4320 rows of GOA units, and the GOA driving architecture utilizes 12CK signal lines (12 clock signal lines), therefore an impedance difference of the CK signal line can reach up to 1000 ohms. As a result, there is a difference between the CK pattern and the scan line waveform output by the corresponding GOA unit, causing the panel to display horizontal lines and othe similar problems.

Therefore, current 8K ultra-high resolution electronic devices have at least a technical problem in that the difference in the CK impedance causes a difference between the output signals of each GOA unit, which needs to be improved.

SUMMARY OF INVENTION

The present disclosure provides a display panel and an electronic device to alleviate the technical problem of a difference of the output signal of the GOA unit caused by a CK impedance difference existing in the currently 8K ultra-high resolution electronic device.

To solve the above problems, the technical solutions provided by the present disclosure are as follows:

The present disclosure provides a display panel, comprising:

m GOA units arranged in a column direction, wherein each of the GOA units comprises a pull-up module, and the pull-up module comprises a clock input transistor connected to a clock signal;

n clock signal lines extending in the column direction and arranged in parallel; and m clock signal connection lines extending in a row direction and arranged in parallel, wherein the m clock signal connection lines are corresponding one-by-one with the m GOA units, and configured to connect the clock input transistor of the pull-up module of the GOA unit to the corresponding clock signal line;

wherein the n clock signal lines comprise a $n1^{st}$ clock signal line and a $n2^{nd}$ clock signal line, the $n2^{nd}$ clock signal line is formed on a side of the $n1^{st}$ clock signal line away from the GOA unit, and a voltage drop value of the clock input transistor of the pull-up module of a $m1^{st}$ GOA unit connected to the $n1^{st}$ clock signal line is greater than a voltage drop value of the clock input transistor of the pull-up module of a $m2^{nd}$ GOA unit connected to the $n2^{nd}$ clock signal line In the display panel of the present disclosure, a size of the clock input transistor of the pull-up module of the $m1^{st}$ GOA unit is greater than a size of the clock input transistor of the pull-up module of the $m2^{nd}$ GOA unit.

In the display panel of the present disclosure, the clock input transistor comprises a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit.

In the display panel of the present disclosure, a source area of the clock input transistor of the pull-up module of the $m1^{st}$ GOA unit is greater than a source area of the clock input transistor of the pull-up module of the $m2^{nd}$ GOA unit; and/or a drain area of the clock input transistor of the pull-up module of the $m1^{st}$ GOA unit is greater than a drain area of the clock input transistor of the pull-up module of the $m2^{nd}$ GOA unit.

In the display panel of the present disclosure, a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit.

In the display panel of the present disclosure, a $n^{th}$ level GOA unit of the M GOA units comprises:

a pull-up control module connected to a first node, and configured to raise an electrical potential of the first node during a display period;

a logical addressing module comprising a second node, wherein the logical addressing module is connected to the first node, configured to raise an electrical potential of the second node twice during the display period, and configured to raise the electrical potential of the first node through the second node during a blank period;

a pull-up module connected to the first node, and configured to raise electrical potentials of a $n^{th}$ level transmission signal, a first output signal, and a second output signal;

a first pull-down module connected to the first node, and configured to pull down the electrical potential of the first node during the blank period;

a second pull-down module connected to the first node and a third node, and configured to pull down electrical potentials of the first node and the third node respectively during the display period;

a third pull-down module connected to the third node and the second pull-down module, and configured to pull down the electrical potential of the third node during the blank period;

a first pull-down maintenance module comprising the third node, wherein the first pull-down maintenance module is connected to the first node and the first pull-down module, and configured to maintain the first node at a low electrical potential; and a second pull-down maintenance module connected to the third node and the pull-up module, and configured to maintain the n-th level transmission signal, the first output signal, and the second output signal at the low electrical potential.

In the display panel of the present disclosure, the pull-up control module comprises a first transistor and a second transistor, a gate and a first electrode of the first transistor and a gate of the second transistor are connected to a $n-2^{th}$ level transmission signal, a second electrode of the first transistor is connected to a first electrode of the second transistor and a fourth node, and a second electrode of the second transistor is connected to the first node.

In the display panel of the present disclosure, a material resistivity of a source-drain layer of the clock input transistor of the pull-up module of the $m1^{st}$ GOA unit is greater than a material resistivity of a source-drain layer of the clock input transistor of the pull-up module of the $m2^{nd}$ GOA unit.

In the display panel of the present disclosure, a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit.

In the display panel of the present disclosure, a contact area between a drain and an active layer of the clock input transistor of the pull-up module of the $m1^{st}$ GOA unit is smaller than a contact area between a drain and an active layer of the clock input transistor of the pull-up module of the $m2^{nd}$ GOA unit.

The present disclosure also provides an electronic device comprising a display panel, the display panel comprising:

m GOA units arranged in a column direction, wherein each of the GOA units comprises a pull-up module, and the pull-up module comprises a clock input transistor connected to a clock signal;

n clock signal lines extending in the column direction and arranged in parallel; and m clock signal connection lines extending in a row direction and arranged in parallel, wherein the m clock signal connection lines are corresponding one-by-one with the m GOA units, and configured to connect the clock input transistor of the pull-up module of the GOA unit to the corresponding clock signal line;

wherein the n clock signal lines comprise a $n1^{st}$ clock signal line and a $n2^{nd}$ clock signal line, the $n2^{nd}$ clock signal line is formed on a side of the $n1^{st}$ clock signal line away from the GOA unit, and a voltage drop value of the clock input transistor of the pull-up module of a $m1^{st}$ GOA unit connected to the $n1^{st}$ clock signal line is greater than a voltage drop value of the clock input transistor of the pull-up module of a $m2^{nd}$ GOA unit connected to the $n2^{nd}$ clock signal line.

In the electronic device of the present disclosure, a size of the clock input transistor of the pull-up module of the $m1^{st}$ GOA unit is greater than a size of the clock input transistor of the pull-up module of the $m2^{nd}$ GOA unit.

In the electronic device of the present disclosure, the clock input transistor comprises a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit.

In the electronic device of the present disclosure, a source area of the clock input transistor of the pull-up module of the $m1^{st}$ GOA unit is greater than a source area of the clock input transistor of the pull-up module of the $m2^{nd}$ GOA unit; and/or a drain area of the clock input transistor of the pull-up module of the $m1^{st}$ GOA unit is greater than a drain area of the clock input transistor of the pull-up module of the $m2^{nd}$ GOA unit.

In the electronic device of the present disclosure, a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit.

In the electronic device of the present disclosure, a $n^{th}$ level GOA unit of the m GOA units comprises:

a pull-up control module connected to a first node, and configured to raise an electrical potential of the first node during a display period;

a logical addressing module comprising a second node, wherein the logical addressing module is connected to the first node, configured to raise an electrical potential of the second node twice during the display period, and configured to raise the electrical potential of the first node through the second node during a blank period;

a pull-up module connected to the first node, and configured to raise electrical potentials of a $n^{th}$ level transmission signal, a first output signal, and a second output signal;

a first pull-down module connected to the first node, and configured to pull down the electrical potential of the first node during the blank period;

a second pull-down module connected to the first node and a third node, and configured to pull down electrical potentials of the first node and the third node respectively during the display period;

a third pull-down module connected to the third node and the second pull-down module, and configured to pull down the electrical potential of the third node during the blank period;

a first pull-down maintenance module comprising the third node, wherein the first pull-down maintenance module is connected to the first node and the first pull-down module, and configured to maintain the first node at a low electrical potential; and a second pull-down maintenance module connected to the third node and the pull-up module, and configured to maintain the $n^{th}$ level transmission signal, the first output signal, and the second output signal at the low electrical potential.

In the electronic device of the present disclosure, the pull-up control module comprises a first transistor and a second transistor, a gate and a first electrode of the first transistor and a gate of the second transistor are connected to a $n-2^{th}$ level transmission signal, a second electrode of the first transistor is connected to a first electrode of the second transistor and a fourth node, and a second electrode of the second transistor is connected to the first node.

In the electronic device of the present disclosure, a material resistivity of a source-drain layer of the clock input transistor of the pull-up module of the $m1^{st}$ GOA unit is greater than a material resistivity of a source-drain layer of the clock input transistor of the pull-up module of the $m2^{nd}$ GOA unit.

In the electronic device of the present disclosure, a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit.

In the electronic device of the present disclosure, a contact area between a drain and an active layer of the clock input transistor of the pull-up module of the $m1^{st}$ GOA unit is smaller than a contact area between a drain and an active layer of the clock input transistor of the pull-up module of the $m2^{nd}$ GOA unit.

Beneficial effect of the present disclosure: The present disclosure provides a display panel and an electronic device, the display panel comprising m GOA units arranged in a column direction, each of the GOA units comprises a pull-up module, the pull-up module comprises a clock input transistor connected to a clock signal; n clock signal lines extending in the column direction and arranged in parallel; and m clock signal connection lines extending in a row direction and arranged in parallel, the m clock signal connection lines corresponding one-to-one with the m GOA unit, configured to connect the clock input transistor of the pull-up module of the GOA unit to the corresponding clock signal line; wherein the n clock signal lines comprise $n1^{st}$ clock signal line and $n2^{nd}$ clock signal line, the $n2^{nd}$ clock signal line is formed on a side away from the GOA unit of the $n1^{st}$ clock signal line, a voltage drop value of the clock input transistor of pull-up module of $m1^{st}$ GOA unit connected to the $n1^{st}$ clock signal line is greater than a voltage drop value of the clock input transistor of pull-up module of $m2^{nd}$ GOA unit connected to the $n2^{nd}$ clock signal line. Based on this circuit structure, by adjusting the voltage drop values of the clock input transistors of different GOA units, the voltage drop values caused by the different lengths of the clock signal line and the clock signal connection line can be compensated. Thereby making the voltage drop value between each GOA unit and the clock driving chip are approximately the same, alleviating the CK impedance difference existing in 8K ultra-high resolution electronic device and improves the technical problems of 8K ultra-high resolution electronic devices that lead by the difference in the output signal of the GOA unit.

DESCRIPTION OF DRAWINGS

In order to more clearly illustrate the embodiments or the technical solutions in the prior art or the embodiment, the figures used in the description of the embodiments or the prior art will be briefly introduced below. Obviously, the figures in the following description are merely some embodiments of the present disclosure, for those of ordinary skill in the art, other figures may be obtained based on these figures without inventive steps.

DETAILED DESCRIPTION OF PREFERRED EMBODIMENTS

Figure 1:
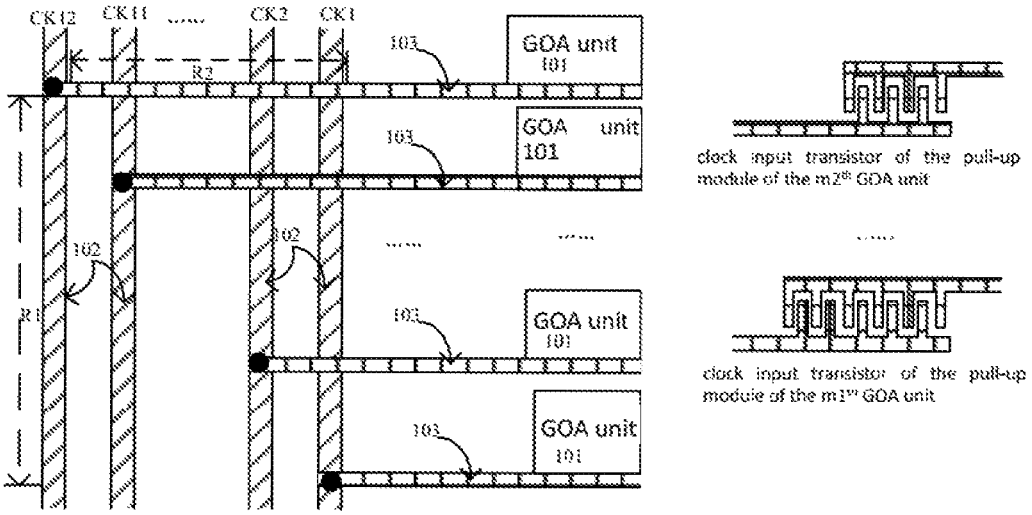
FIG. 1 is a schematic structural diagram of a display panel of one embodiment of the present disclosure.

The following is a description of each embodiment with reference to additional figures to illustrate specific embodiments in which the present disclosure can be implemented. The directional terms mentioned in the present disclosure, such as up, down, front, back, left, right, inside, outside, side, etc., are only directions referring to the figures. Therefore, the directional terms are to explain and understand the disclosure, not to limit it. In the figure, similarly structured units are denoted by the same reference numerals.

In the following, the technical solutions in the embodiments of the present disclosure will be clearly and completely described with reference to the figures. Obviously, the described embodiments are only some embodiments of the present disclosure, not all the embodiments. Based on the embodiments in the present disclosure, all other embodiments obtained by a person of ordinary skill in the art without creative steps shall fall within the protection scope of the present disclosure.

In the description of the present disclosure, it should be understood that the terms of center, longitudinal, transverse, length, width, thickness, upper, lower, front, rear, left, right, vertical, horizontal, top, bottom, inside, outside, clockwise, counterclockwise, etc. or a positional relationship based on orientation or position shown in the figures are only for the convenience of describing the present disclosure and simplifying the description, rather than indicating or implying the device or element referred to must have a specific orientation, structure, or operation. Therefore, it cannot be understood as a limitation of the present disclosure. In addition, the terms "first" and "second" are used for descriptive purposes only, and cannot be understood as indicating or implying relative importance or implicitly indicating the number of technical features indicated. Therefore, the features defined as "first" and "second" may explicitly or implicitly include one or more of the features. In the present disclosure, "/" means "or"

In the description of the present disclosure, it should be noted that the terms "installation", "linked", and "connected" should be understood in a broad sense unless explicitly stated and limited otherwise. For example, it can be fixed connection, removable connection, or integral connection; it can be mechanical or electrical connection; it can be directly connected, indirectly connected through an intermediate medium, or it can be an internal communication of two elements. For those of ordinary skill in the art, the specific meanings of the above terms in the present disclosure can be understood on a case-by-case basis.

In the present disclosure, unless otherwise clearly specified and defined, the first feature "above" or "below" the second feature may include the direct contact of the first and second features, or may include the first and second features Contact not directly but through another feature between them. Moreover, the first feature is "above", "above" and "above" the second feature includes that the first feature is directly above and obliquely above the second feature, or simply means that the first feature is higher in level than the second feature. The first feature is "below", "below" and "below" the second feature includes that the first feature is directly below and obliquely below the second feature, or simply means that the first feature is less horizontal than the second feature.

In the present application, unless explicitly specified and defined otherwise, a first feature being "on" or "under" a second feature may be that the first feature and the second feature are in direct contact, or the first feature and the second feature are in indirect contact through an intermediary. In addition, the first feature being "on", "over" and "above" the second feature may be that the first feature is just above or diagonally above the second feature, or merely represents that a horizontal height of the first feature is higher than that of the second feature. The first feature being "under", "below" and "underneath" the second feature may be that the first feature is just below or diagonally below the second feature, or merely represents that the horizontal height of the first feature is lower than that of the second feature.

The following disclosure provides many different implementations or examples for implementing different structures of the present disclosure. To simplify the disclosure of the present disclosure, the components and settings of specific embodiments are described below. Of course, they are merely embodiments and are not intended to limit the present disclosure. In addition, the present disclosure may repeat reference numbers and/or reference letters in different embodiments, and such repetition is for simplicity and clarity and does not indicate the relationship between the various embodiments and/or settings discussed. In addition, embodiments of various specific processes and materials are provided in the present disclosure, but those of ordinary skill in the art may be aware of the present disclosure of other processes and/or the use of other materials.

The present disclosure provides a display panel and an electronic device to alleviate the technical problem that a difference between the output signals of the GOA units caused by a CK impedance difference existing of currently 8K ultra-high resolution electronic device.

As shown in FIG. 1, the display panel provided by the embodiment of the present disclosure comprises:

m GOA units 101 arranged in a column direction, wherein each of the GOA units 101 comprises a pull-up module, and the pull-up module comprises a clock input transistor connected to a clock signal;

n clock signal lines 102 extending in the column direction and arranged in parallel; and m clock signal connection lines 103 extending in a row direction and arranged in parallel, wherein the m clock signal connection lines 103 correspond one-by-one with the GOA units 101, and are configured to connect the clock input transistor of the pull-up module of the GOA unit 101 to the corresponding clock signal line 102;

wherein the n clock signal lines comprise a $n1^{st}$ clock signal line and a $n2^{nd}$ clock signal line, the $n2^{nd}$ clock signal line is formed on a side of the $n1^{st}$ clock signal line away from the GOA unit, and a voltage drop value of the clock input transistor of the pull-up module of a $m1^{st}$ GOA unit connected to the $n1^{st}$ clock signal line is greater than a voltage drop value of the clock input transistor of the pull-up module of a $m2^{nd}$ GOA unit connected to the $n2^{nd}$ clock signal line, wherein n1 and n2 are different and belong to 1 to n, m1 and m2 are different and belong to 1 to m.

Taking the resolution of the display panel 100 as 7680*4320 as an example, the display panel 100 includes 4320 GOA units 101 and 12 clock signal lines 102 (CK1 to CK12 in FIG. 1), each clock signal line 102 is connected to 360 GOA units 101, then it can be foreseen that in the column direction and row direction, the difference in voltage drop between the GOA unit 101 (m2) connected to CK12 and the GOA unit 101 (m1) connected to CK1 is the sum of the resistance R1 and R2, and times the current I, the sum of resistance R1 and resistance R2 can reach thousand of ohms. Based on the current situation, the present disclosure abandons improving voltage drop of the clock signal line, and innovatively proposes adjusting the parameters of the clock input transistor of the GOA unit (that is, the thin film transistor connected to the external clock signal) to change its corresponding voltage drop value.

One embodiment of the present disclosure provides a display panel, comprising m GOA units arranged in a column direction, each of the GOA units comprising a pull-up module, the pull-up module comprising a clock input transistor connected to a clock signal; n clock signal lines extending in the column direction and arranged in parallel; and m clock signal connection lines extending in a row direction and arranged in parallel, the m clock signal connection lines corresponding one-to-one with the m GOA units, configured to connect the clock input transistor of the pull-up module of the GOA unit to the corresponding clock signal line; wherein the n clock signal lines comprise the $n1^{st}$ clock signal line and the $n2^{nd}$ clock signal line, the $n2^{nd}$ clock signal line is formed on a side away from the GOA unit of the $n1^{st}$ clock signal line, a voltage drop value of the clock input transistor of pull-up module of $m1^{st}$ GOA unit connected to the $n1^{st}$ clock signal line is greater than a voltage drop value of the clock input transistor of pull-up module of $m2^{nd}$ GOA unit connected to the $n2^{nd}$ clock signal line. Based on this circuit structure, by adjusting the voltage drop values of the clock input transistors of different GOA units, the voltage drop values caused by the different lengths of the clock signal line and the clock signal connection line can be compensated. Therefore, by making the voltage drop value between each GOA unit and the clock driving chip are approximately the same, this alleviates the CK impedance difference existing in 8K ultra-high resolution electronic devices and improves the technical problems of 8K ultra-high resolution electronic devices that lead to differences in the output signal of the GOA unit.

In one embodiment, the display panel 100 comprises an active layer, a first metal layer, and a second metal layer, the active layer is patterned to form a channel region of a transistor, the first metal layer is patterned to form at least one gate, at least one gate Scan line, and at least one clock signal line, the second metal layer is patterned to form at least one clock signal connection line, at least one source and drain of the transistor, etc. At this time, the at least one CK signal is connected to the at least one source of the clock input transistor of the GOA unit, the at least one CK signal inputted through the clock signal line (the first metal layer) and transmitted through the adapter hole to the clock signal connection line (the second metal layer) to the source of the clock input transistor.

In one embodiment, the parameters of the clock input transistor comprise multiple dimensions such as a size of the transistor, a resistivity of the film material, and a thickness of the film layer. For clock input transistors connected to different clock signal lines, one or multiple parameters may be adjusted at the same time so that all the voltage drops between the GOA units connected to all of the clock signal lines and the clock driving chip are approximately the same.

In one embodiment, the voltage drop values of clock input transistors belonging to different GOA units but are connected to the same clock signal line are the same.

In one embodiment, the size parameters of the clock input transistors connected to different clock signal lines are different, that is, a size of the clock input transistor of the pull-up module of the $m1^{st}$ GOA unit is greater than a size of the clock input transistor of the pull-up module of the $m2^{nd}$ GOA unit.

In one embodiment, as shown in FIG. 1, the clock input transistor includes a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit. In an actual preparation process, each transistor is implemented by a series of sub-transistors of the array. The greater the number of sub-transistors in the series, the greater the resistance of the transistor. The embodiment adjusts the sub-transistors in the transistor in response, in other words, the embodiment can be obtained by changing a number of light-shielding regions of the mask corresponding to sub-transistors of the clock input transistor in different GOA units.

Figure 2A:
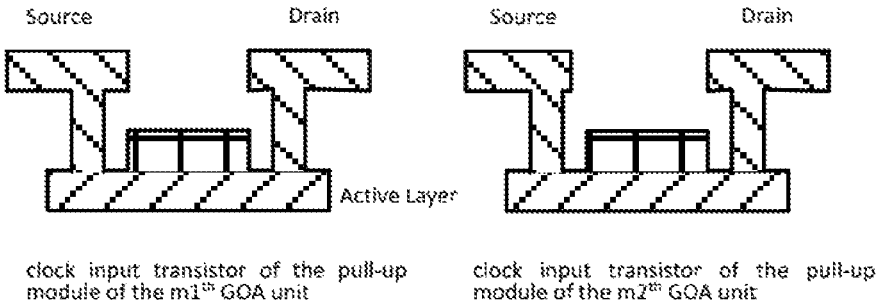
FIG. 2*a* to FIG. 2*f* are schematic diagrams of shapes of transistors of embodiments of the present disclosure.

In one embodiment, as shown in FIG. 2*a*, a source area of the clock input transistor of the pull-up module of the $m1^{st}$ GOA unit is greater than a source area of the clock input transistor of the pull-up module of the $m2^{nd}$ GOA unit. For a situation when active layer parameters, gate parameters, drain parameters (including material resistivity, area, thickness), and partial source parameters (including material resistivity, thickness) are the same, the larger the source area, the greater the resistance of the transistor, and one embodiment of the present disclosure adjusts the voltage drop values of the transistor based on the above feature. In other words, one embodiment can be obtained by adjusting an area of the light-shielding of the mask corresponding to the source of the clock input transistor of different GOA units during preparation.

Figure 2B:
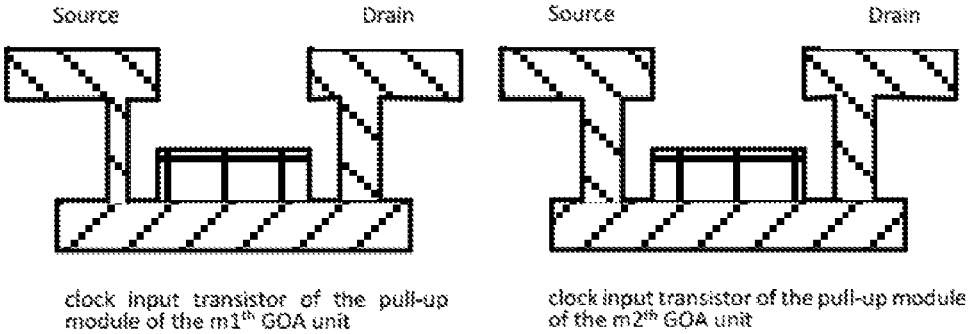

In one embodiment, as shown in FIG. 2*b*, a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit. For the situation when active layer parameters, gate parameters, drain parameters (including material resistivity, area, thickness), and source parameters (including material resistivity, area, thickness) are the same, the smaller the source area, the lower the resistance of the transistor, and one embodiment of the present disclosure adjusts the voltage drop values of the transistor based on the above feature. In other words, one embodiment can be obtained by adjusting the area of a through-hole of the mask corresponding to the source of the clock input transistor of different GOA units during preparation.

Figure 2C:
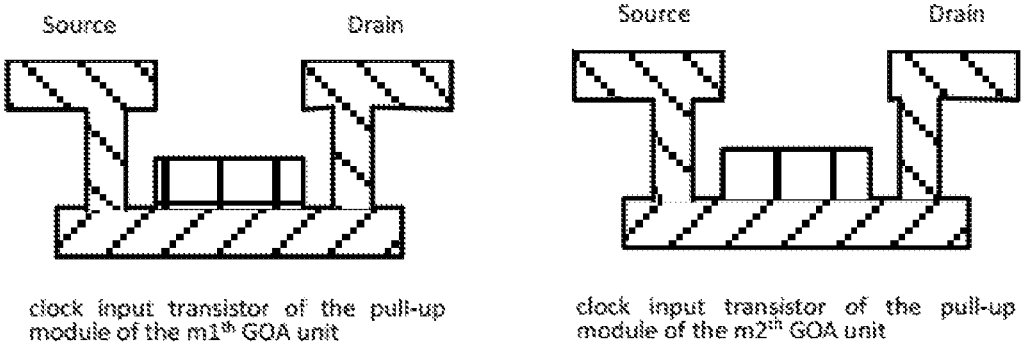

In one embodiment, as shown in FIG. 2*c*, a drain area of the clock input transistor of the pull-up module of the $m1^{st}$ GOA unit is greater than a drain area of the clock input transistor of the pull-up module of the $m2^{nd}$ GOA unit. For the situation when active layer parameters, gate parameters, source parameters (including material resistivity, area, thickness), partial drain parameters (including material resistivity, thickness) are the same, the greater the drain area, the greater the transistor resistance, one embodiment of the present disclosure adjusts the voltage drop values of the transistor based on the above feature. In other words, one embodiment can be obtained by adjusting the area of the light-shielding of the mask corresponding to the drain of the clock input transistor of different GOA units during preparation.

Figure 2D:
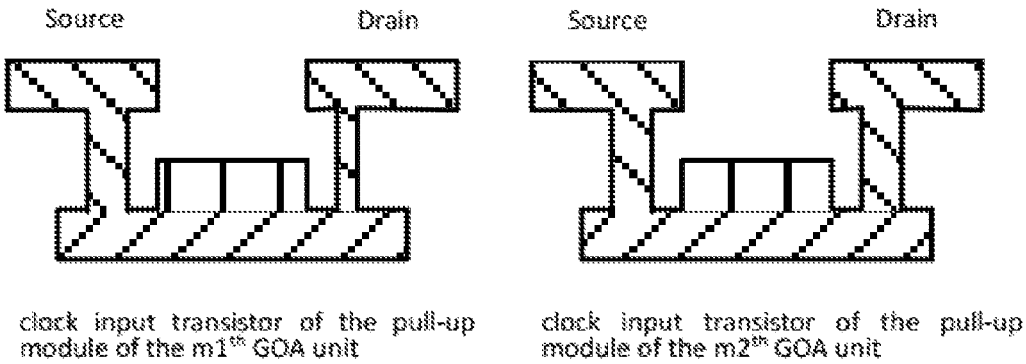

In one embodiment, as shown in FIG. 2*d*, a contact area between a drain and an active layer of the clock input transistor of the pull-up module of the $m1^{st}$ GOA unit is smaller than a contact area between the drain and the active layer of the clock input transistor of the pull-up module of the $m2^{nd}$ GOA unit. For the situation when active layer parameters, gate parameters, drain parameters (including material resistivity, area, thickness), and source parameters (including material resistivity, area, thickness) are the same, the smaller the drain area, the less the resistance of the transistor, one embodiment of the present disclosure adjusts the voltage drop values of the transistor based on the above feature. In other words, one embodiment can be obtained by adjusting the area of the through-hole of the mask corresponding to the drain of the clock input transistor of different GOA units during preparation.

Figure 2E:
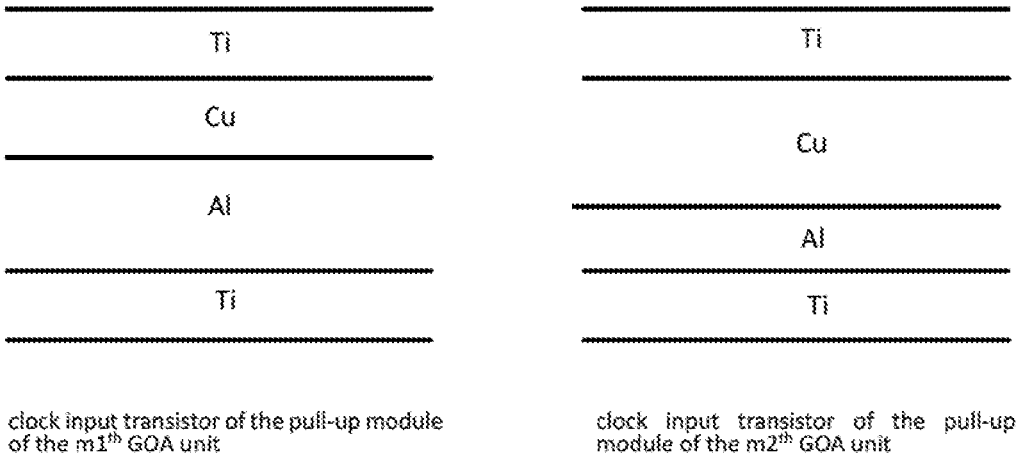

In one embodiment, a material resistivity of a source-drain layer of the clock input transistor of the pull-up module of the $m1^{st}$ GOA unit is greater than a material resistivity of a source-drain layer of the clock input transistor of the pull-up module of the $m2^{nd}$ GOA unit. For the situation when active layer parameters, gate parameters, partial drain parameters (including area, thickness), and partial source parameters (including area, thickness) are the same, the material resistivity of the source-drain layer is greater, a resistance value of the transistor is greater, one embodiment of the present disclosure adjusts the voltage drop values of the transistor based on the above feature. During the preparation, it is only necessary to use materials with different resistivities, or change the material ratio of materials with different resistivities to obtain the embodiment. As shown in FIG. 2*e*, in one embodiment, the source-drain materials of the present disclosure include a 4-layer structure, which are metal titanium Ti, metal aluminum Al, metal copper Cu, and metal titanium Ti in order from bottom to top. On a basis that a certain thickness is required of the metal aluminum Al and the metal copper Cu layers within the thickness of the entire film layer, thicknesses of the metal aluminum Al and the metal copper Cu can be changed to change the resistivity of the source-drain layer materials, because a resistivity of copper is less than a resistivity of aluminum. In other words, one embodiment can be obtained when depositing a metal layer, a thicker aluminum layer is deposited for the source-drain layer of the clock input transistor of the pull-up module of the $m1^{st}$ GOA unit, and a thinner aluminum layer is deposited for the source-drain layer of the clock input transistor of the pull-up module of the $m2^{nd}$ GOA unit.

Figure 2F:
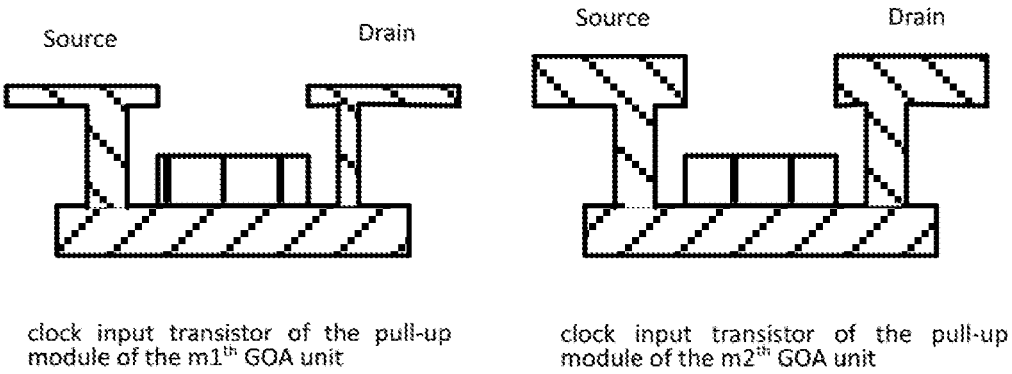

In one embodiment, as shown in FIG. 2*f*, a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit. For the situation when active layer parameters, gate parameters, partial drain parameters (including resistivity, area), and partial source parameters (including resistivity, area) are the same, the thinner the thickness of the source-drain layer materials, the greater the resistance of transistor, one embodiment of the present disclosure adjusts the voltage drop values of the transistor based on the above feature. In other words, one embodiment can be obtained by disposing different thicknesses source-drain layers in different regions.

Figure 3:
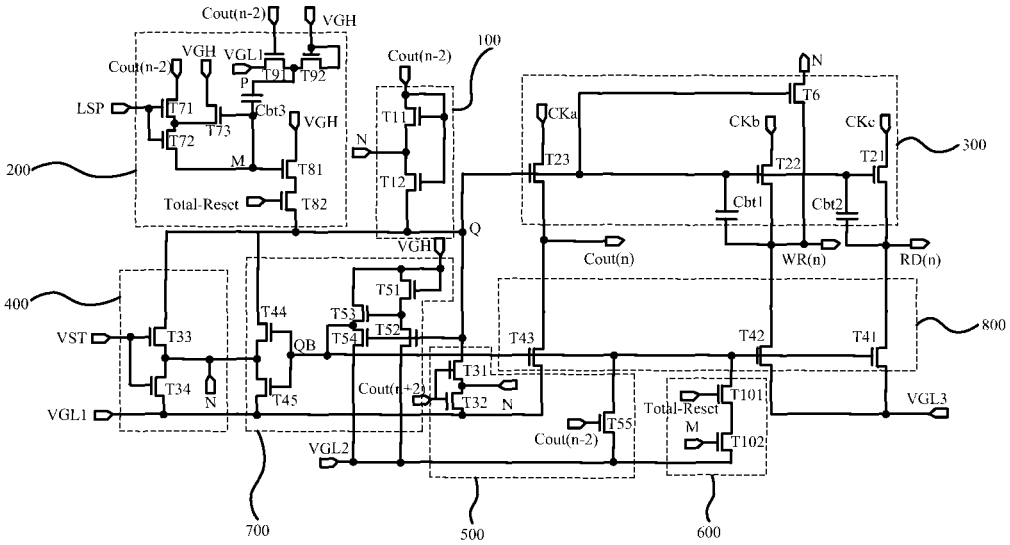
FIG. 3 is a schematic structural diagram of a GOA circuit of one embodiment of the present disclosure.

As the resolution of the display panel increases, the signal output by the GOA unit needs to be compensated in real time. Based on this, one embodiment of the present disclosure also provides a GOA circuit. As shown in FIG. 3, in one embodiment of the present disclosure, the GOA circuit includes m cascaded GOA units 101, wherein the GOA unit includes a pull-up control module 100, a logical addressing module 200, a pull-up module 300, a first pull-down module 400, a second pull-down module 500, a third pull-down module 600, a first pull-down maintenance module 700, and a second pull-down maintenance module 800.

The pull-up control module 100 is connected to a first node Q, and configured to raise an electrical potential of the first node Q during a display period.

The logical addressing module 200 includes a second node M, wherein the logical addressing module is connected to the first node, and is configured to raise an electrical potential of the second node twice during the display period, and raise the electrical potential of the first node through the second node during the blank period.

The pull-up module 300 is connected to the first node Q, and is configured to raise electrical potentials of a $n^{th}$ level transmission signal Cout(n), a first output signal WR(n), and a second output signal RD(n).

The first pull-down module 400 is connected to the first node Q, and is configured to pull down the electrical potential of the first node Q during the blank period.

The second pull-down module 500 is connected to the first node Q and a third node QB, and configured to pull down electrical potentials of the first node Q and the third node QB respectively during the display period.

The third pull-down module 600 is connected to the third node QB and the second pull-down module 500, and is configured to pull down the potential of the third node QB during the blank period.

The first pull-down maintenance module 700 includes the third node QB, wherein the first pull-down maintenance module 700 is connected to the first node Q and the first pull-down module 400, and configured to maintain the first node Q at the low electrical potential.

The second pull-down maintenance module 800 is connected to the third node QB and the pull-up module 300, and configured to maintain the $n^{th}$ level transmission signal Cout(n), the first output signal WR(n), and the second output signal RD(n) at the low electrical potential.

The display panel require through the display period Programming and the blank period Blank to display the picture, wherein the display period is an actual display period of each frame picture, and the blank period is a period between the time of actual display of the adjacent frame pictures.

In one embodiment, the electrical potential of the second node M is raised twice during the display period, so that the charging rate of the first node Q can be ensured during the blank period, which further increases the threshold voltage margin allowed by the GOA circuit, improving a stability of the GOA circuit, and reducing a development difficulty of the transistor manufacturing process.

As shown in FIG. 3, the pull-up control module 100 includes a first transistor T11 and a second transistor T12, a gate and a first electrode of the first transistor T11 and a gate of the second transistor T12 are configured to receive the $n-2^{th}$ level transmission signal Cout(n−2), a second electrode of the first transistor T11 is connected to a first electrode of the second transistor T12, and a second electrode of the second transistor T12 is connected to the first node Q.

The logical addressing module 200 includes a third transistor T91, a fourth transistor T92, a fifth transistor T71, a sixth transistor T72, a seventh transistor T73, an eighth transistor T81, a ninth transistor T91, and a first storage capacitor Cbt3. A gate of the third transistor T91 is configured to receive a $n-2^{th}$ level transmission signal Cout(n−2), a first electrode of the third transistor T91 is connected to a first low electrical potential signal VGL1, a second electrode of the third transistor T91 is connected to a first electrode of the fourth transistor T92, a gate and a second electrode of the fourth transistor T92 are both configured to receive a high electrical potential signal VGH, a gate of the fifth transistor T71 is connected to the first input signal LSP, a first electrode of the fifth transistor T71 is configured to transmit/receive the $n-2^{th}$ level transmission signal Cout(n−2), a second electrode of the fifth transistor T71 is connected to a first electrode of the sixth transistor T72 and a first electrode of the seventh transistor T73, a gate of the sixth transistor T72 is connected to a first input signal, a second electrode of the sixth transistor T72 and a gate of the seventh transistor T73 are both connected to the second node M, a second electrode of the seventh transistor T73 is configured to transmit/receive the high electrical potential signal VGH, and a gate of the eighth transistor T81 is connected to the second node M, a first electrode of the eighth transistor T81 is configured to transmit/receive the high electrical potential signal VGH, a second electrode of the eighth transistor T81 is connected to a first electrode of the ninth transistor T91, a gate of the ninth transistor T91 is configured to transmit/receive a reset signal Total-Reset, the second electrode of the ninth transistor T91 is connected to the first node Q, a first plate of the first storage capacitor Cbt3 is connected to the second electrode of the third transistor T91, and a second plate of the first storage capacitor Cbt3 is connected to the second node M.

The pull-up module 300 includes a tenth transistor T23, an eleventh transistor T22, a twelfth transistor T21, a thirteenth transistor T6, a second storage capacitor Cbt1, and a third storage capacitor Cbt2. A gate of the tenth transistor T23, a gate of the eleventh transistor T22, and a gate of the twelfth transistor T21 are connected to the first node Q, a first electrode of the tenth transistor T23 is connected to a first clock signal CKa, a second electrode of the tenth transistor T23 is connected to an $n^{th}$ level transmission signal Cout(n), a first electrode of the eleventh transistor T22 is connected to a second clock signal CKb, a second electrode of the eleventh transistor T22 is connected to a first output signal WR(n), a first electrode of the twelfth transistor T21 is connected to a third clock signal CKc, a second electrode of the twelfth transistor T21 is connected to a second output signal RD(n), a gate of the thirteenth transistor T6 is connected to the first node Q, a first electrode of the thirteenth transistor T6 is connected to the fourth node N, a second electrode of the thirteenth transistor T6 is connected to the first output signal WR(n), a first plate of the second storage capacitor Cbt1 is connected to the first node Q, a second plate of the second storage capacitor Cbt1 is connected to the first output signal WR(n), a first plate of the third storage capacitor Cbt2 is connected to the first node Q, and a second plate of the third storage capacitor Cbt2 is connected to the second output signal RD(n).

The first pull-down module 400 includes a fourteenth transistor T33 and a fifteenth transistor T34, a gate of the fourteenth transistor T33 and a gate of the fifteenth transistor T34 are both connected to a second input signal VST, a first electrode of the fourteenth transistor T33 is connected to the first node Q, a second electrode of the fourteenth transistor T33 is connected to the first electrode of the fifteenth transistor T34 and the fourth node N, and a second electrode of the fifteenth transistor T34 is connected to the first low electrical potential signal VGL1.

The second pull-down module 500 includes a sixteenth transistor T31, a seventeenth transistor T32, and an eighteenth transistor T55, a gate of the sixteenth transistor T31, and a gate of the seventeenth transistor T32 are connected to a $n+2^{th}$ level transmission signal Cout (n+2), a first electrode of the sixteenth transistor T31 is connected to the first node Q, a second electrode of the sixteenth transistor T31 is connected to a first electrode of the seventeenth transistor T32 and a fourth node N, a second electrode of the seventeenth transistor T32 is connected to the first low electrical potential signal VGL1, a gate of the eighteenth transistor T55 is connected to a $n-2^{th}$ level transmission signal Cout (n−2), a first electrode of the eighteenth transistor T55 is connected to a second low electrical potential signal VGL2, a first electrode of the eighteenth transistor T55 is connected to the third node QB.

The third pull-down module 600 includes a nineteenth transistor T102 and a twentieth transistor T101, the gate of the nineteenth transistor T102 is connected to the second node, and the first electrode of the nineteenth transistor T102 is connected to the second low electrical potential signal VGL2. The second electrode of the nineteenth transistor T102 is connected to the first electrode of the twentieth transistor T101, the gate of the twentieth transistor T101 is connected to the reset signal Total-Reset, and the second electrode of the twentieth transistor T101 is connected to the third node QB.

The first pull-down sustaining module 700 includes a twenty-first transistor T44, a twenty-second transistor T45, a twenty-third transistor T51, a twenty-fourth transistor T52, a twenty-fifth transistor T53, and a twenty-sixth transistor T54, a gate of the twenty-first transistor T44 and a gate of the twenty-second transistor T45 are connected to the third node QB, a first electrode of the twenty-first transistor T44 is connected to the first node Q, a second electrode of the twenty-first transistor T44 is connected to a first electrode of the twenty-second transistor T45 and the fourth node N, a second electrode of the twenty-second transistor T45 is connected to the first low electrical potential signal VGL1, a gate and a first electrode of the twenty-third transistor T51 is configured to receive the high electrical potential signal VGH, the second electrode of the twenty-third transistor T51 is connected to a first electrode of the twenty-fourth transistor T52, a gate of the twenty-fourth transistor T52 is connected to the first node Q, a second electrode of the twenty-fourth transistor T52 is connected to the second low electrical potential signal VGL2, a gate of the twenty-fifth transistor T53 is connected to a second electrode of the twenty-third transistor T51, a first electrode of the twenty-fifth transistor T53 is connected to the high electrical potential signal VGH, a second electrode of the twenty-fifth transistor T53 is connected to a first electrode of the twenty-sixth transistor T54 and the third node QB, a gate of the twenty-sixth transistor T54 is connected to the first node Q, and a second electrode of the twenty-sixth transistor T54 is connected to the second low electrical potential signal VGL2.

The second pull-down maintenance module 800 includes a twenty-seventh transistor T43, a twenty-eighth transistor T42, and a twenty-ninth transistor T41, a gate of the twenty-seventh transistor T43, a gate of the twenty-eighth transistor T42, and a gate of the twenty-ninth transistor T41 are connected to the third node QB, a first electrode of the twenty-seventh transistor T43 is connected to the first low-potential signal VGL1, a second electrode of the twenty-seventh transistor T43 is connected to the $n^{th}$ level transmission signal Cout(n), a first electrode of the twenty-eighth transistor T42 is connected to the third low electrical potential signal VGL3, a second electrode of the twenty-eighth transistor T42 is connected to the first output signal WR(n), a second electrode of the twenty-ninth transistor T41 is connected to the third low electrical potential signal VGL3, a second electrode of the twenty-ninth transistor T41 is connected to the second output signal RD(n).

In the GOA circuit of the present disclosure, there are m cascaded GOA units, wherein the signal output by the $n^{th}$ level GOA unit is the $n^{th}$ level transmission signal Cout(n), $2 \leq n \leq m$, and n is an integer. The $n-2^{th}$ level transmission signal Cout(n−2) is the level transmission signal before and separated from the $n^{th}$ level transmission signal Cout(n), and the $n+2^{th}$ level transmission signal Cout (n+2) is the cascade signal before the $n^{th}$ level transmission signal Cout(n) and separated by one level from it.

In the GOA circuit of the present disclosure, the first input signal LSP, the second input signal VST, and the reset signal Total-Reset are all provided by an external timing device.

Figure 4A:
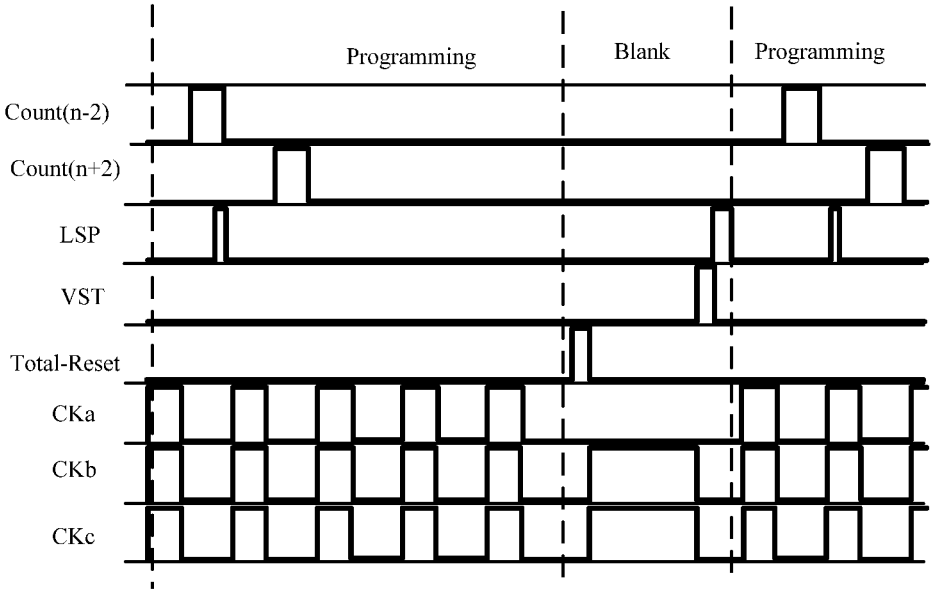
FIG. 4*a* to FIG. 4*c* are timing diagrams of embodiments of the present disclosure.

The GOA circuit provided in the embodiments of the present disclosure is a real-time compensation circuit, which requires the GOA to output a normal drive timing display screen in the display period corresponding to each frame, and to output a wide pulse timing in the blank period between each frame for detecting a threshold voltage Vth. FIG. 4*a* shows the timing of the signals in the GOA circuit of the embodiment of the present disclosure in the display period Programming and the blank period Blank, wherein the voltage setting values of the signals at a high electrical potential and at a low electrical potential are shown in Table 1.

TABLE 1

| GOA signal | Setting Voltage | |
|---|---|---|
| | Low electrical potential | High electrical potential |
| Cout(n − 2) | −13 | +20 |
| Cout(n + 2) | −13 | +20 |
| LSP | −13 | +20 |
| VST | −13 | +20 |
| Total-Reset | −13 | +20 |
| CKa | −13 | +20 |
| CKb | −13 | +20 |
| CKc | −13 | +20 |
| VGH | +20 | |
| VGL1 | −13 | |
| VGL2 | −10 | |
| VGL3 | −6 | |

The operation of the GOA circuit in the display period and the blank period will be specifically described below with reference to FIGS. 4*b* and 4*c*.

Figure 4B:
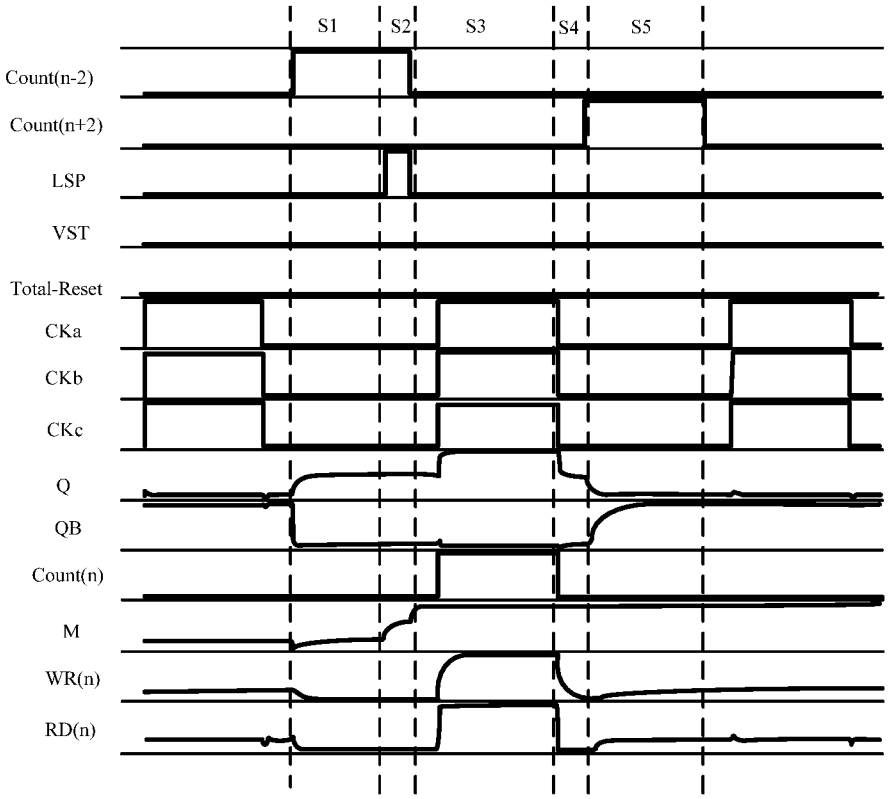

As shown in FIG. 4*b*, the display period includes a first display stage S1, a second display stage S2, a third display stage S3, a fourth display stage S4, and a fifth display stage S5.

During the first display stage S1, the $n-2^{th}$ level transmission signal Cout(n−2) raised to the high electrical potential, the first transistor T11 and the second transistor T12 are turned on, the first node Q is raised to the high electrical potential, the twenty-fourth transistor T52, the twenty-sixth transistor T54, the tenth transistor T23, the eleventh transistor T22 and the twelfth transistor T21 are turned on, because the connection between the first node Q and the third node QB constitutes an inverter structure, the potential between them is opposite. So, when the third node QB is at the low electrical potential, the twenty-seventh transistor T43, the twenty-eighth transistor T42, the twenty-ninth transistor T41, the twenty-first transistor T44, and the twenty-second transistor T45 are turned off, and at the same time, the $n+2^{th}$ level transmission signal Cout (n+2) is at the low electrical potential, the sixteenth transistor T31 and the seventeenth transistor T32 are turned off, the second input signal VST is at the low electrical potential, and the fourteenth transistor T33 and the fifteenth transistor T34 are turned off. The first timing signal CKa, the second timing signal CKb, and the third timing signal CKc are at the low electrical potential, the $n^{th}$ level transmission signal Cout(n), the first output signal WR(n), and the second output signal RD(n) output the low electrical potential. Since the $n-2^{th}$ level transmission signal Cout(n−2) is at the high electrical potential, the third transistor T91 is turned on, a point P connected to the first plate of the first storage capacitor Cbt3 is reset to the low electrical potential, and the second plate connected to the second node M is at the low electrical potential at the same time.

During the second display stage S2, the first input signal LSP is raised to the high electrical potential, at this time the n−2$^{th}$ level transmission signal Cout(n−2) is maintained at the high electrical potential, the second node M is raised to the high electrical potential, and the fourth transistor T92 is turned on, point P is maintained at the low electrical potential, because the reset signal Total-Reset and the second input signal VST are at the low electrical potential, the first node Q is maintained at the high electrical potential, and the third node QB is maintained at the low electrical potential.

During the third display stage S3, the first input signal LSP is dropped from the high electrical potential to the low electrical potential, the fifth transistor T71 and the sixth transistor T72 are turned off, and the n−2$^{th}$ level transmission signal Cout(n−2) changes from the high electrical potential to the low electrical potential, therefore the third transistor T91 is turned off, and the electrical potential of the point P is switched from the low electrical potential to the high electrical potential. Due to the presence of the first storage capacitor Cbt3, the second node M is coupled and raised to a higher electrical potential. The first timing signal Cka, the second timing signal CKb, and the third timing signal CKc are switched from the low electrical potential to the high electrical potential, so the electrical potential of n$^{th}$ level transmission signal Cout(n), the first output signal WR(n), and the second output signal RD(n) are also raised to the high electrical potential, at the same time, due to the existence of the second storage capacitor Cbt1 and the third storage capacitor Cbt2, the first node Q is coupled to a higher electrical potential.

During the fourth display stage S4, the first timing signal Cka, the second timing signal CKb, and the third timing signal CKc are switched from the high electrical potential to the low electrical potential, the n$^{th}$ level transmission signal Cout(n), the first output signal WR(n), and the second output signal RD(n) are pulled to the low electrical potential, and the signal coupling of the first node Q decreases, which coincides with the electrical potential of the second display stage S2.

During the fifth display stage S5, the n+2$^{th}$ level transmission signal Cout (n+2) is raised from the low electrical potential to the high electrical potential, the sixteenth transistor T31 and the seventeenth transistor T32 are turned on, the electrical potential of the first node Q is pulled down to the low electrical potential, the twenty-fourth transistor T52, the twenty-sixth transistor T54, the tenth transistor T23, the eleventh transistor T22, and the twelfth transistor T21 are turned off, and the electrical potential of the third node QB is raised to the high electrical potential, the twenty-seventh transistor T43, the twenty-eighth transistor T42, the twenty-ninth transistor T41, the twenty-first transistor T44 and the twenty-second transistor T45 are all turned on, and the first node Q, the n$^{th}$ level transmission signal Cout(n), the first output signal WR(n), and the second output signal RD(n) are maintained at the low electrical potential.

Figure 4C:
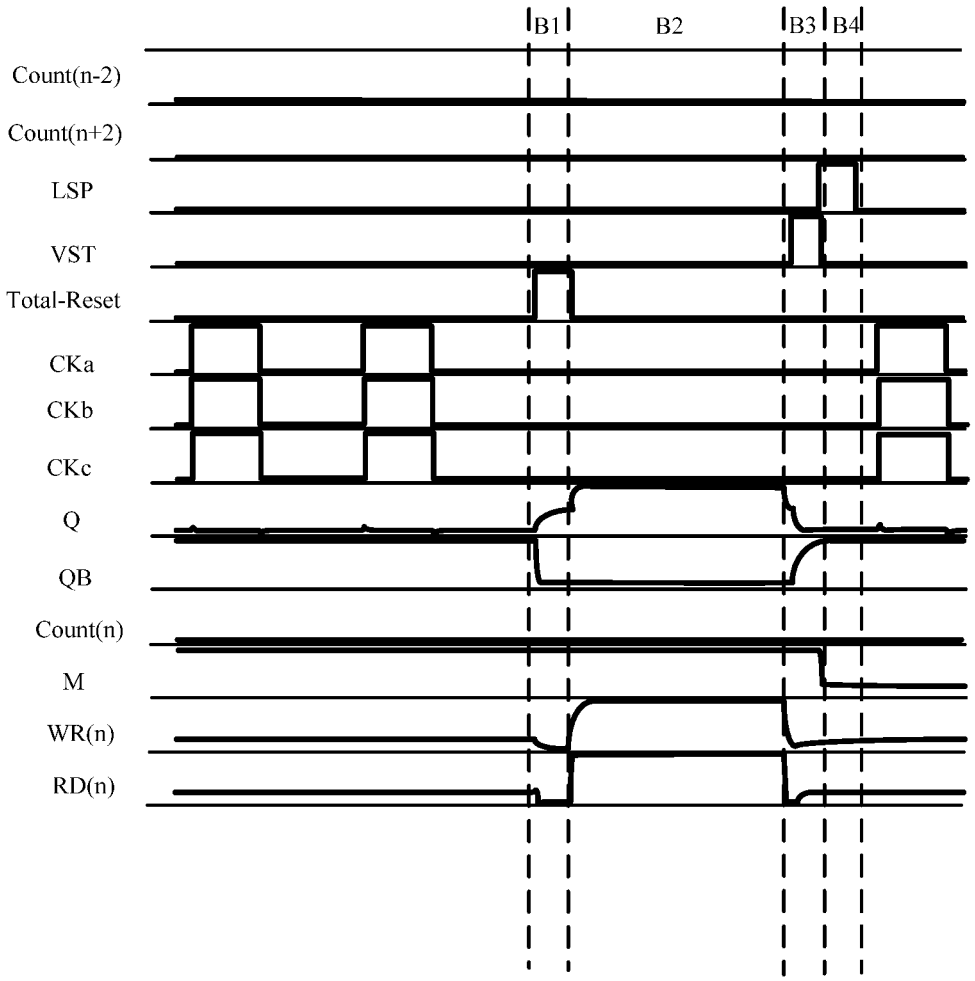

As shown in FIG. 4*c*, the blank period includes a first blank stage B1, a second blank stage B2, a third blank stage B3, and a fourth blank stage B4.

During the first blank stage B1, the reset signal Total-Reset raised to the high electrical potential, the ninth transistor T82 is turned on, the electrical potential of the first node Q raised to the high electrical potential, the twenty-fourth transistor T52, the twenty-sixth transistor T54, the tenth transistor T23, the eleventh transistor T22, and the twelfth transistor T21 are turned on. Since the connection between the first node Q and the third node QB constitutes an inverter structure, the potential between them is opposite, so the third node QB is at the low electrical potential, the twenty-seventh transistor T43, the twenty-eighth transistor T42, the twenty-ninth transistor T41, the twenty-first transistor T44 and the twenty-second transistor T45 are all turned off, and at the same time, the n+2$^{th}$ level transmission signal Cout (n+2) is at the low electrical potential, the sixteenth transistor T31 and the seventeenth transistor T32 are turned off, the second input signal VST is at the low electrical potential, and the fourteenth transistor T33 and the fifteenth transistor T34 are turned off. The first timing signal CKa, the second timing signal CKb, and the third timing signal CKc are all at the low electrical potential, and the n$^{th}$ level transmission signal Cout(n), the first output signal WR(n), and the second output signal RD(n) output the low electrical potential.

In the second blank stage B2, the reset signal Total-Reset falls to the low electrical potential, the ninth transistor T82 is turned off, the first timing signal Cka maintains the low electrical potential, the second timing signal CKb and the third timing signal CKc are raised to the high electrical potential, and the n$^{th}$ level transmission signal Cout(n) maintains at the low electrical potential. The first output signal WR(n) and the second output signal RD(n) output the high electrical potential. The first node Q is coupled to a higher potential.

In the third blank stage B3, the second input signal VST is raised from the low electrical potential to the high electrical potential, the fourteenth transistor T33 and the fifteenth transistor T34 are turned on, the potential of the first node Q is pulled down to the low electrical potential, the twenty-fourth transistor T52, the twenty-sixth transistor T54, the tenth transistor T23, the eleventh transistor T22, and the twelfth transistor T21 are turned off, the electrical potential of the third node QB is raised to the high electrical potential, the twenty-seventh transistor T43, the twenty-eighth transistor T42, the twenty-ninth transistor T41, the twenty-first transistor T44, and the twenty-second transistor T45 are all turned on, the first node Q, the first output signal WR(n), and the second output signal RD(n) are pulled down to the low electrical potential, and the n$^{th}$ level transmission signal Cout(n) is maintained at the low electrical potential.

In the fourth blank stage B4, the first input signal LSP raised to the high electrical potential, the fifth transistor T71 and the sixth transistor T72 are turned on, and since the n−2$^{th}$ level transmission signal Cout(n−2) is at the low electrical potential, the second node M is reset to the low electrical potential and the eighth transistor T81 is turned off. The first node Q, the n$^{th}$ level transmission signal Cout(n), the first output signal WR(n), and the second output signal RD(n) are maintained at the low electrical potential.

In the embodiments of the present disclosure, the GOA circuit is a real-time compensation type GOA circuit. Through the above process, a driving signal is provided to the scanning line, so that the display panel displays a picture.

In the above process, by disposing the third transistor T91 and the fourth transistor T92 on the first plate side of the first storage capacitor Cbt3, both the third transistor T91 and the fourth transistor T92 are turned on in the first display stage S1, so that the electrical potential of the point P and the second node M are at the low electrical potential. In the second display stage S2, both the third transistor T91 and the fourth transistor T92 are turned on, the electrical potential of the point P remains at the low electrical potential, and the electrical potential of the second node M raised for a first time. In the third display stage S3, the third transistor T91 is turned off, the fourth transistor T92 is turned on, and the electrical potential of the point P raised. Due to the coupling effect, the electrical potential of the second node M raised a second time, therefore, during the first blank stage B1, the electrical potential of the first node Q is pulled higher than that of the prior art, and the charging rate is guaranteed, which in turn increases the threshold voltage margin allowed by the GOA circuit and improves the stability of the GOA circuit, thereby reducing the development difficulty of the transistor manufacturing process.

In the embodiment shown in FIG. 3, the tenth transistor T23, the eleventh transistor T22, and the twelfth transistor T21 in the pull-up module 300 are all clock input transistors in the above, in the embodiment shown in FIG. 3, the clock driver chip needs to input 3 clock signals CKa, CKb and CKc to the same GOA unit, then at this time, each clock signal line is divided into 3 sub-clock signal lines to transmit CKa, CKb and CKc, each clock signal connection line is divided into three sub-clock signal connection lines, and the clock signals CKa, CKb, and CKc are respectively connected to the corresponding clock input transistors.

For the 8K ultra-high resolution display panel, except for the technical problems of the CK impedance difference existing in the above 8K electronic devices, at least the following technical problems still exist:

an area of a single sub-pixel of the 8K resolution electronic device is a quarter of an area of a single sub-pixel of a 4K resolution electronic device, which is accompanied by a difficulty in preparing the corresponding mask and an increase in cost. In an actual product preparation process, for display panels of the same resolution and different sizes, due to the different areas of individual sub-pixels, masks of different sizes need to be developed and prepared. For example, in the prior art, when manufacturing 65-inch 8K resolution display panels and 85-inch 8K resolution display panels, different size masks are required, and the development cost is high, wherein the size of the mask refers to the size of the shading area on the mask, that is, current 8K electronic devices experience a technical problem in panel manufacture of different-sized masks corresponding to different-sized display panels; and because the area of a single sub-pixel of an 8K resolution electronic device is a quarter of the area of the single sub-pixel of the 4K resolution electronic device, which is accompanied with a reduction in the contact area between the support pillar (ps) and the bottom layer of the display panel, in 8K resolution electronic devices, the contact area between the support pillar and the bottom layer is 20 μm*20 μm or even smaller. Such a small contact area will cause the support pillar to easily peel off from the bottom layer, and a peeling off the support pillar will cause the liquid crystal to appear blank, and will cause an uneven distribution of pressure across the whole surface.

The sub-pixels of each pixel of the LCD panel are arranged in rows. In the present disclosure, the arrangement direction of the sub-pixels is the row direction, and the way perpendicular to the row direction is the column direction. A row width value refers to a size of the width value of certain area in the row direction.

In the present disclosure, a repeating area refers to an area on the mask plate, the mask plate is composed of distributing repeating areas, the pixel area refers to an area corresponding to a smallest light-emitting unit (ie, sub-pixel) of the display panel. The pixel area including the light exitting area and the light shielding area surrounding the light exitting area; in the process of manufacturing the display panel, aligning the mask plate and the substrate is to align the repeating area of the mask plate with the pixel area of the substrate.

Figure 5:
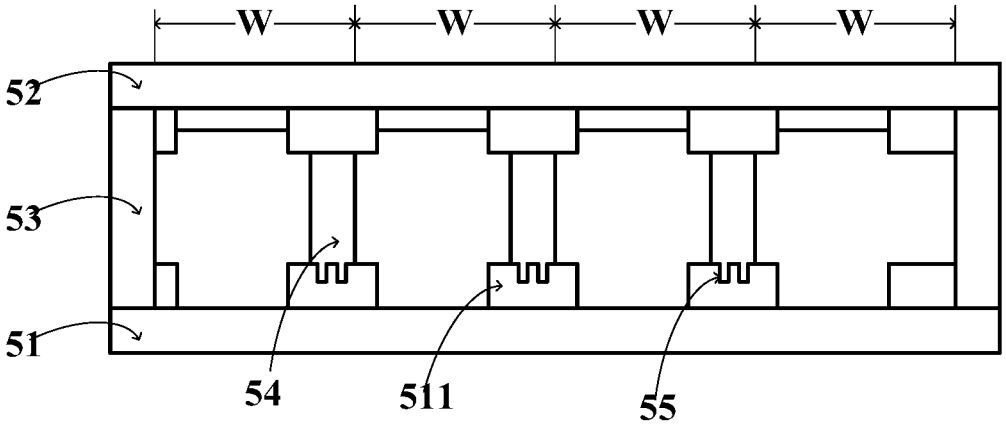
FIG. 5 is another schematic structural diagram of the display panel of one embodiment of the present disclosure.

In order to solve above technical problems, in one embodiment, as shown in FIG. 5, the display panel of one embodiment of the present disclosure includes:

an array substrate 51 formed with a driving circuit layer and a plurality of pixel electrodes;

a color film substrate 52 arranged opposite to the array substrate 51;

a plastic frame 53 configured to encapsulate the array substrate 51 and the color filter substrate 52, and forming a sealed space which is filled with liquid crystal, and a plurality of support pillars 54 formed on the array substrate 51 or the color filter substrate, and configured to support the array substrate 51 and the color filter substrate 52.

Figure 6:
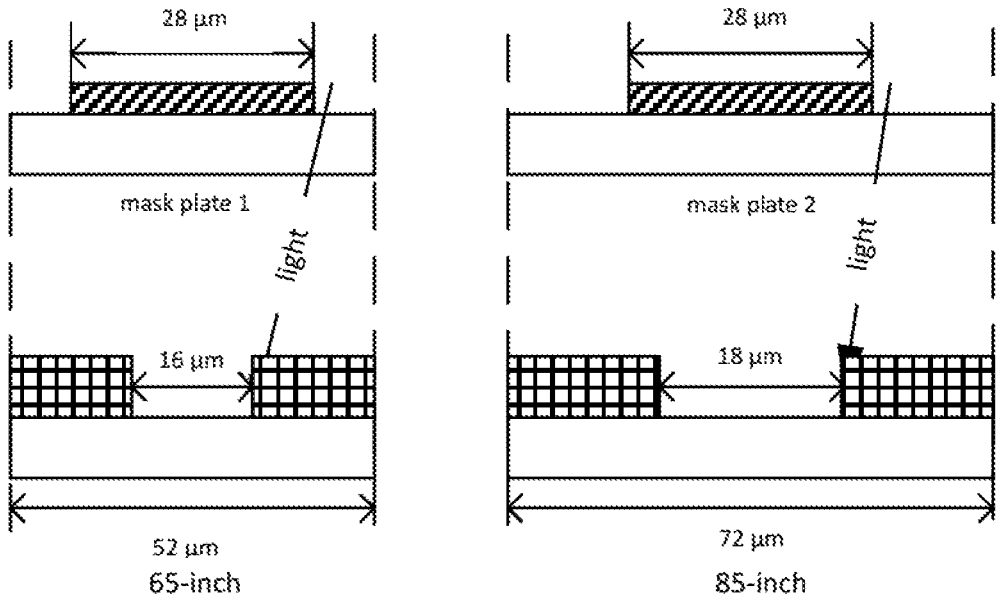
FIG. 6 is a schematic diagram of an existing mask plate involved embodiments of the present disclosure.

In one embodiment, for the technical problem of manufacturing different-sized display panels by different-sized masks, please refer to FIG. 6. FIG. 6 is a schematic diagram of the effect of the current mask plate. The shading area of the mask plate is set in the middle of the pixel area. As shown in FIG. 6, a row width of a single sub-pixel in the 65-inch 8K resolution display panel is 52 μm, a row width value of the pixel area of a mask plate 1 in the 65-inch 8K resolution display panel is also 52 μm, a row width value of a single sub-pixel in the 85-inch 8K resolution display panel is 72 μm, and a row width value of the pixel area of a mask plate 2 in the 85-inch 8K resolution display panel is also 72 μm. If masks of the same size are used, that is, when the row width of the shading area is 28 μm, the row width of the single light-transmitting area of the mask plate 1 is 12 μm in the row direction, and the row width value of the single light-transmitting area of the mask 2 is 22 μm. During photolithography, a slit is formed in the light-transmitting region, and light is diffracted through the slit. According to the principle of light diffraction, the smaller the slit, the larger the diffraction range of light.

A black matrix is a negative photoresist, and the area not exposed to light is etched to form an opening. Then, as shown in FIG. 6, the row width value of the actual effective occlusion range of the shading area of the mask plate 1 is 16 μm (that is, the diffraction range of a single slit is 6 μm). The row width of the light-emitting area is 16 μm, the row width of the actual effective occlusion range of the mask plate 2 shading area is 18 μm (that is, the diffraction range of a single slit is 5 μm), and a row width of the light-emitting area of a single sub-pixel of the 85-inch 8K resolution display panel is 18 μm, which also meets the principle of light diffraction. However, this will cause the row width of the light-emitting area of a single sub-pixel of the 65-inch 8K resolution display panel to be different from the row width of the light-emitting area of the single sub-pixel of the 85-inch 8K resolution display panel. In the subsequent manufacturing of RGB color film layers, different sizes masks need to be used. Therefore, current 8K electronic devices have still encounter technical problems in preparing mask plates of different sizes for display panels of different sizes. The present disclosure further provides a mask plate, a display panel, and an electronic device, which can solve the technical problem of manufacturing different size display panels by different size masks.

Figure 7A:
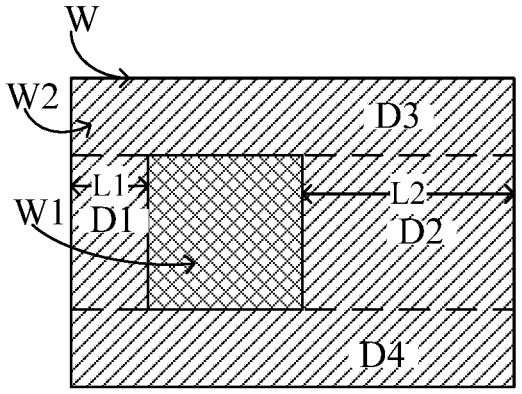
FIG. 7*a* to FIG. 7*d* are schematic diagrams of a color filter substrate and a corresponding mask of embodiments of the present disclosure.
Figure 7B:
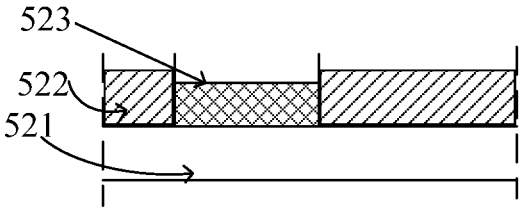

In order to solve these problems, as shown in FIGS. 7*a* to 7*b*, the color filter substrate includes:

a base substrate 521;

a black matrix 522 formed on the base substrate, the black matrix including openings for filling the color film layer 523; and a color film layer 523 formed in the opening;

wherein as shown in FIG. 7*a* and FIG. 7*b*, the color filter substrate includes a plurality of pixel regions W arranged in an array and corresponding to sub-pixels. The pixel region W includes a first region W1 corresponding to the opening and a second region W2 surrounding the first area W1, the second area W2 is formed with the black matrix 522; the second area W2 includes a first side area D1 and a second side area D2 arranged in a row direction and parallel to each other, and a third side region D3 and a fourth side region D4 arranged in parallel in the column direction; a first distance L1 that the side of the first side region D1 away from the opening to the opening is less than a second distance L2 that the side of the second side region D2 away from the opening to the opening.

Based on this structure, display panels of the same resolution and different sizes can use masks of the same size. The difference between these masks is only the distance between the opening pattern and the edge of the pixel area, which solves the technical problem of manufacturing different size display panels by different size masks, and reduces the cost of product preparation.

In one embodiment, in 85 inches and more than 85 inches 8K resolution display panel, in the row direction, the value of the first distance L1 is less than 18 μm, and the value of the second distance L2 is greater than 18 μm.

In one embodiment, in 85-inch 8K resolution display panel, in the row direction, the width of the opening is 16 μm, and the sum of the first distance L1 and the second distance L2 is 56 μm.

Figure 7C:
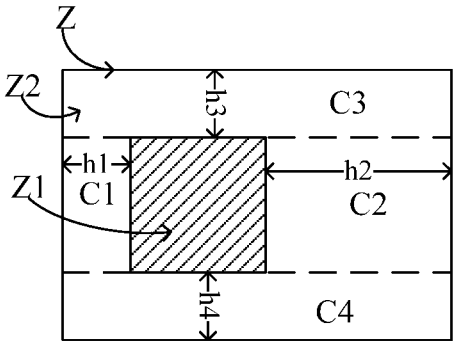
Figure 7D:
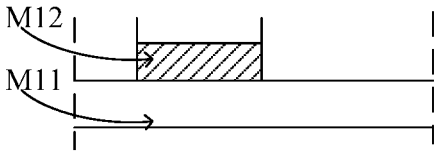

In order to prepare the color filter substrate shown in FIGS. 7*a* to 7*b*, the present disclosure also provides the mask shown in FIGS. 7*c* to 7*d*. As shown in FIGS. 7*c* to 7*d*, the mask provided by the present disclosure includes:

a mask substrate M11; and an opening graphic pattern M12, formed on the mask substrate M11, is configured to form a black matrix or a color film layer of the color filter substrate, and the black matrix includes openings configured to fill the color filter layer;

wherein the mask plate includes a plurality of repeating regions Z, and the repeating regions Z include a first region Z1 corresponding to the opening pattern M12 and a second region Z2 surrounding the first region Z1; the second region Z2 includes a first side region C1 and a second side region C2 arranged in parallel in the row direction, and a third side region C3 and a fourth side region C4 arranged in parallel in the column direction; a third distance h1 that the side of the first side region C1 away from the opening pattern M12 to the opening pattern M12 is less than a fourth distance h2 that the side of the second side region C2 away from the opening pattern M12 to the opening pattern M12.

In one embodiment, the mask plate of the present disclosure abandons the currently mask plate opening pattern, such as the shading area located in the center of the repeating area, and moves it to the side, so that the target size black matrix opening or color film layer can be obtained based on the diffraction effect, while the size of the opening pattern is not needed to be changed. Based on this structure, the display panel with the same resolution and different sizes can using the same size mask. The difference between these mask plates is only the distance between the opening pattern and the Z edge of the repeating area, solving the technical problem of current 8K resolution display panel that the manufacture different-sized display panels must use different-sized masks, reducing the cost of product preparation.

In one embodiment, a fifth distance h3 from a side of the third side region C3 away from the opening pattern M12 to the opening pattern M12 is equal to a sixth distance h4 away from a side of the opening pattern M12 of the fourth side region C4 to the opening pattern M12.

In one embodiment, the mask plate is configured to prepare the 85 inches and more than 85 inches 8K resolution display panel, a value of the third distance h1 is less than 12 μm, and a value of the fourth distance h2 is greater than 32 μm.

In one embodiment, the mask plate is configured to prepare the 85 inches and more than 85 inches 8K resolution display panel, a value of the third distance h1 is less than 10 μm, and a value of the fourth distance h2 is greater than 34 μm.

In one embodiment, the mask plate is configured to prepare the 85 inches and more than 85 inches 8K resolution display panel, a value of the width of the opening pattern M12 in the row direction is 28 μm.

In one embodiment, when the mask plate is configured to prepare the 85 inches and more than 85 inches 8K resolution display panel, a sum of the third distance h1 and the fourth distance h2 is 44 μm in the mask plate of the present disclosure.

In one embodiment, the opening pattern M12 is formed by patterning a material with a light transmittance is 0, and the material includes metallic chromium and the like.

In one embodiment, a straight line with 0 light transmittance is formed between adjacent repeating regions Z to ensure the slit effect. A width of the straight line is less than 1 μm, which does not affect the pattern of the black matrix below the repeating regions Z.

Figure 9A:
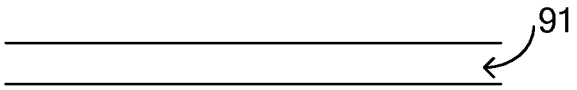
FIG. 9*a* to FIG. 9*o* are schematic diagrams of preparation of the display panel of one embodiment of the present disclosure.
Figure 9B:
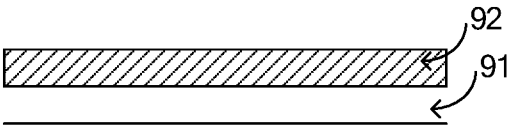
Figure 9C:
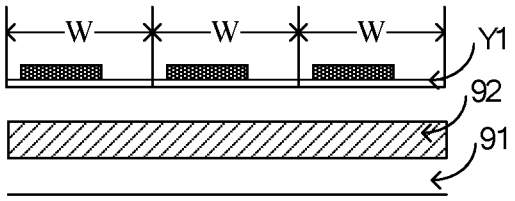
Figure 9D:
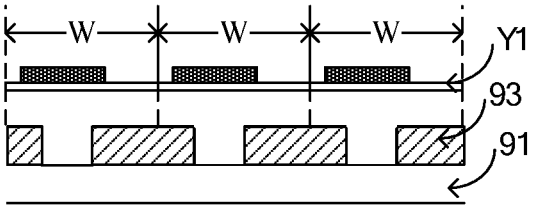
Figure 9E:
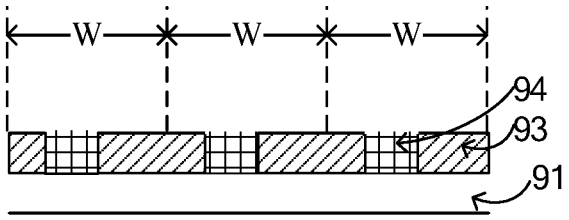
Figure 9F:
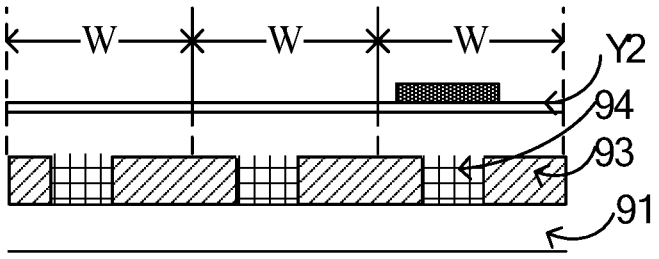
Figure 9G:
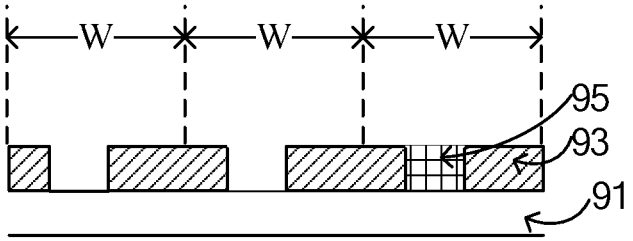
Figure 9H:
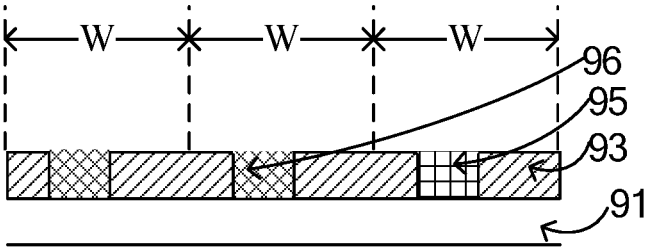
Figure 9I:
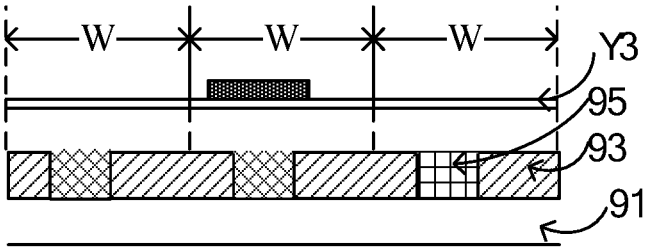
Figure 9J:
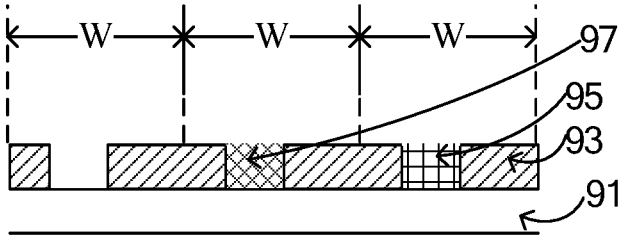
Figure 9K:
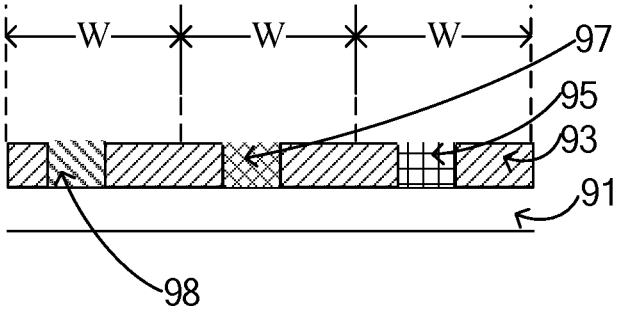
Figure 9L:
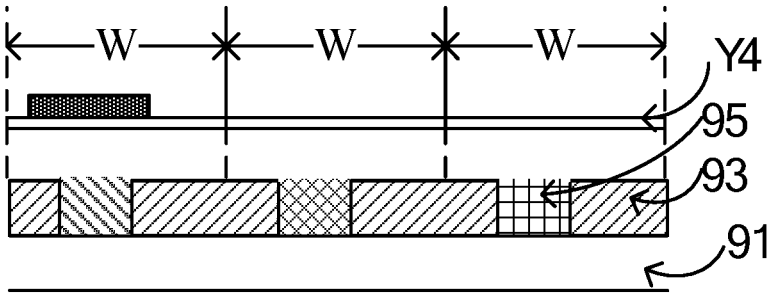
Figure 9M:
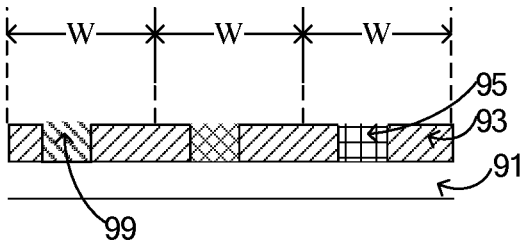
Figure 9N:
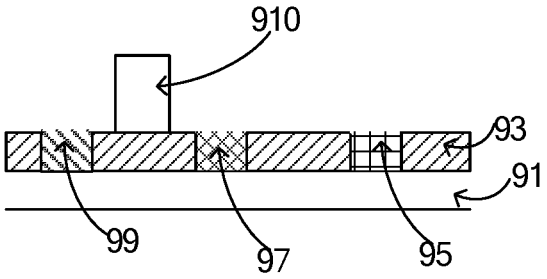
Figure 9O:
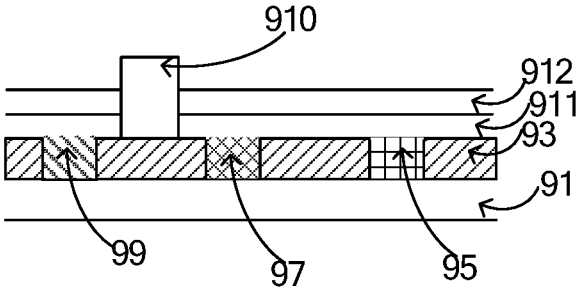

In one embodiment, in order to obtain a color filter substrate of the embodiment shown in FIG. 7*b*, as shown in FIGS. 9*a* to 9*o*, one embodiment of the present disclosure further provides the following method for manufacturing the color filter substrate, which includes:

Step 1: Providing a base substrate.

As shown in FIG. 9*a*, a transparent glass substrate or the like is provided as the base substrate 91.

Step 2: Forming a black matrix material layer on the base substrate.

As shown in FIG. 9*b*, a black matrix material layer 92 is formed on a base substrate 91 such as a transparent glass substrate. Among them, the material of the black matrix material layer is negative photoresist, and the area shielded by the mask plate is removed.

Step 3: Aligning the first mask plate and the base substrate.

As shown in FIG. 9*c*, using the first mask Y1, and each repeating area Z corresponding to the pixel area W of the first mask Y1 adopts the design of the embodiment shown in FIGS. 7*c* and 7*d*, and aligning the first mask Y1 with the base substrate obtained in step 2.

Step 4. Patterning the black matrix material to form the black matrix.

As shown in FIG. 9*d*, using a device such as an exposure machine to perform a photolithography process on the black matrix material layer 92 based on the first mask plate to obtain a black matrix 93.

Step 5. Coating a red color resist material layer.

As shown in FIG. 9*e*, coating a red photoresist layer 94 on entire surface of the base substrate obtained in step 4, wherein the material of the red photoresist layer is a positive photoresist, and remaining the area shielded by the mask plate.

Step 6. Aligning the second mask plate and the base substrate.

As shown in FIG. 9*f*, using the second mask Y2, the second mask Y2 adopts the design of the embodiment shown in FIGS. 7*c* and 7*d* only in a region of the repeating region Z corresponding to the pixel region W corresponding to the red sub-pixel. Aligning the second mask Y2 with the base substrate obtained in step 5.

Step 7. Patterning the red photoresist layer.

As shown in FIG. 9*g*, using a device such as an exposure machine to perform photolithography on the red photoresist layer 44 based on the second mask to obtain the red filter layer 95.

Step 8. Coating a green color resist material layer.

As shown in FIG. 9*h*, on the base substrate obtained in step 7, coating a green photoresist layer 96 on the entire surface, wherein the material of the green photoresist layer is a positive photoresist, and remaining the area shielded by the mask plate.

Step 9. Aligning the third mask plate and the base substrate.

As shown in FIG. 9*i*, adopting the third mask Y3, the third mask Y3 adopts the design of the embodiment shown in FIGS. 7*c* and 7*d* only in a region of the repeating region Z corresponding to the pixel region W corresponding to the green sub-pixel. Aligning the third mask Y3 with the base substrate obtained in step 8.

Step 10. Patterning the green photoresist layer.

As shown in FIG. 9*j*, a green mask layer 97 is obtained by performing photolithography on the green photoresist layer 96 based on the third mask using an exposure machine or the like.

Step 11. Coating a blue color resist material layer.

As shown in FIG. 9*k*, a blue photoresist layer 98 is coated on the entire surface of the base substrate obtained in step 10, wherein the material of the blue photoresist layer is a positive photoresist, and the remaining area is shielded by the mask plate.

Step 12. Aligning the fourth mask plate and the base substrate.

As shown in FIG. 91, adopting the fourth mask Y4, the fourth mask Y4 adopts the design of the embodiment shown in FIGS. 7*c* and 7*d* only in a region of the repeating region Z corresponding to the pixel region W corresponding to the blue sub-pixel, and aligning the fourth mask Y4 with the base substrate obtained in step 11.

Step 13. Patterning the blue photoresist layer.

As shown in FIG. 9*m*, the blue photoresist layer 98 is photolithographically processed based on the fourth mask using an exposure machine or the like to obtain a blue filter layer 99.

Step 14. Manufacturing the support column.

As shown in FIG. 9*n*, manufacturing a plurality of supporting columns 910 on the black matrix of the base substrate obtained in step 13.

Step 15. Manufacturing a planarization layer and a common electrode layer.

As shown in FIG. 9*o*, on the base substrate obtained in step 14, macromolecular organic particles are configured to sequentially manufacturing a planarization layer 911, and transparent conductive materials such as TIO are configured to manufacture a common electrode layer 912 on the planarization layer 911.

In one embodiment, in view of the technical problem that the plurality of support pillars are easily peeled off, a display panel with a POA (PS on Array) structure is taken as an example, as shown in FIG. 5, in an area contact with the plurality of support pillars 54, a contact film layer 511 (ie, the bottom layer above) of the array substrate 51 is in contact with the support post 54 and formed with a convex-concave pattern 55 which is configured to increase a contact area of the contact film layer 511 and the plurality of support pillars 54.

In one embodiment, the convex-concave pattern includes a target pattern formed by the contact film layer through at least one of protrusions, depressions, or a combination of protrusions and depressions. For example, the contact film layer form the target pattern through the at least one depressions. In other embodiments, the contact film layer may only form the target pattern by the at least one of the at least one protrusions or combining the at least one of protrusions and depressions. Combining the protrusions and depressions means that a part of the target pattern is formed by protruding the contact film layer, and the other part of the target pattern is formed by depressing the contact film layer.

The display panel of one embodiment of the present disclosure increases the contact area between the support pillar and the bottom layer, and does not need to change the size of a single sub-pixel, alleviating the technical problem of the existing 8K ultra-high resolution electronic device that the support pillar is easily peeled off.

Figure 8:
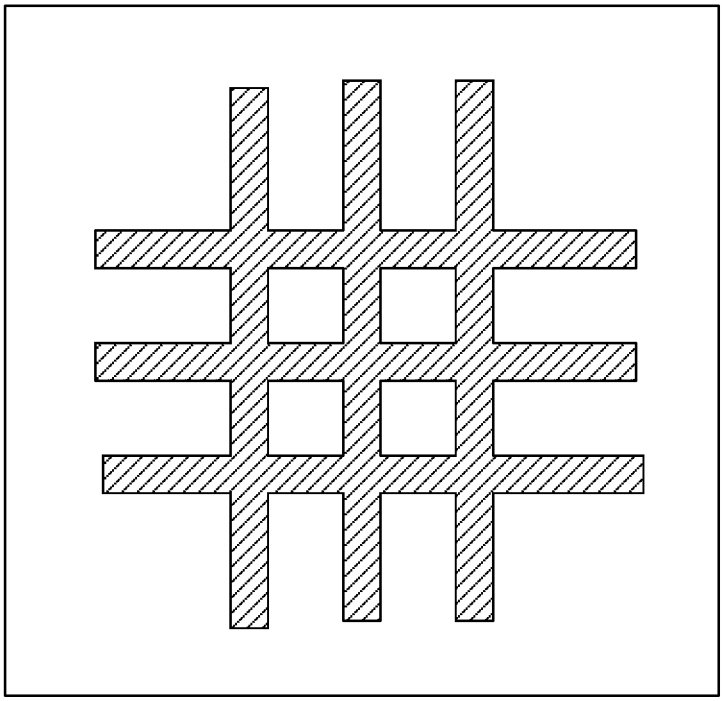
FIG. 8 is a schematic diagram of a designing of a target pattern of one embodiment of the present disclosure.

In one embodiment, as shown in FIG. 8, a shape of the convex-concave pattern 55 provided in the embodiment of the present disclosure corresponds to the target pattern in a grid shape. In some embodiments, the grid size is 1 to 6 μm, the interval is 1 to 6 μm, and the depth is less than 0.5 μm. One embodiment can be obtained by photolithography of the contact film layer (usually an organic material layer) through a mask. For example, for the setting area of the convex-concave pattern, by changing the grid design of the RGB/PFA mask, and using the mask plate has the transmittance 80%~90% to reduce the transmittance, and removing part of the photoresist by the developing solution, which meets the requirement of reducing the film thickness by 0.5 μm to form the convex-concave pattern.

In one embodiment, when the display panel has a COA (Color Filter on Array, RGB on an array substrate) stricture and a non-POA (PS on an array substrate) structure, the plurality of support pillars are formed on the color filter substrate, the color filter substrate includes a base substrate and a black matrix formed on the base substrate, the black matrix is arranged around the array and corresponds to the opening of the light-emitting area of the sub-pixel; the support pillar is formed on the black matrix, that is, the black matrix is the contact film layer above, and the black matrix is formed the convex-concave pattern in the contact area with the support pillar. At this time, the driving circuit is formed in the range of the third side area D3, the convex-concave pattern is formed in the range of the third side area D3, for example, the convex-concave pattern is formed in the third side area D3. Then, correspondingly, in one embodiment, the mask plate is formed in the third side area C3 with a shading pattern corresponding to the convex-concave pattern of the pattern target pattern, and the light transmittance of the shading pattern is 80% to 90% to further achieve the formation of a concave target pattern as a convex-concave pattern in the corresponding area of the black matrix.

In one embodiment, when the display panel has a non-COA (Color Filter on Array, RGB on array substrate) structure and a non-POA (PS on array substrate) structure, the plurality of the support pillars are formed on the color filter substrate, the color filter substrate includes a base substrate, a black matrix formed on the base substrate, and a color filter layer, the black matrix is arranged around the array and corresponds to the color filter layer of the sub-pixel light-emitting area; the support pillar is formed on the black matrix, that is, the black matrix is the above-mentioned contact film layer, and the black matrix is formed with the convex-concave pattern in the contact area with the plurality of support pillars.

In one embodiment, when the display panel has a non-COA (Color Filter on Array, RGB on array substrate) structure and a non-POA (PS on array substrate) structure, the plurality of the support pillars are formed on the color filter substrate, the color filter substrate includes a base substrate, a black matrix formed on the base substrate, and a color filter layer formed on the black matrix; the plurality of support pillars are formed on the color filter layer and is located in the region where the color film layer overlaps with the black matrix. That is, the color film is the contact film layer above, and the color film layer is formed with the convex-concave pattern in the contact area with the plurality of support pillars.

In one embodiment, when the display panel has a non-COA (Color Filter on Array, RGB on array substrate) structure and a non-POA (PS on array substrate) structure, the plurality of the support pillars are formed on the color filter substrate, the color filter substrate includes a base substrate, a black matrix formed on the base substrate, and a color filter layer formed on the black matrix; the plurality of support pillars are formed on the color filter layer and is located in the region where the color film layer overlaps the black matrix. That is, the color film layer is the contact film layer above, the color film layer is formed with a convex-concave pattern in the contact area with the plurality of support pillars, and the black matrix is also formed in the contact area of the color film layer and the plurality of support pillars, and forming the convex-concave pattern.

In one embodiment, when the display panel has a non-COA (Color Filter on Array, RGB on array substrate) structure and a non-POA (PS on array substrate) structure, the plurality of support pillars are formed on the array substrate, the array substrate includes a base substrate, a driving circuit layer formed on the base substrate, and a planarization layer formed on the driving circuit layer; the plurality of support pillars are formed on the planarization layer, that is, the planarization layer is the contact film layer above, the planarization layer is formed with the convex-concave pattern in the contact area with the plurality of support pillars.

In one embodiment, when the display panel has a non-COA (Color Filter on Array, RGB on array substrate) structure and a non-POA (PS on array substrate) structure, the plurality of support pillars are formed on the array substrate, the array substrate includes a base substrate, a driving circuit layer formed on the base substrate, a color resist layer formed on the driving circuit layer, and a planarization layer formed on the color resist layer. The plurality of support pillars are formed on the planarization layer. That is, the planarization layer is the above-mentioned contact film layer, and the planarization layer is formed with a concave-convex pattern in the contact area with the plurality of support pillars.

In one embodiment, when the display panel has a non-COA (Color Filter on Array, RGB on array substrate) structure and a non-POA (PS on array substrate) structure, the plurality of support pillars are formed on the array substrate, the array substrate includes a base substrate, a driving circuit layer formed on the base substrate, a color resist layer formed on the driving circuit layer, and a planarization layer formed on the color resist layer (RGB layer). The plurality of support pillars are formed on the planarization layer. That is, the planarization layer is the above-mentioned contact film layer, the planarization layer is formed with a convex-concave pattern in the contact area with the support pillar, and the color resist layer also form the concave-convex pattern are in the contact area between the planarization layer and the plurality of support pillars.

In one embodiment, a material of the planarization layer is PFA (macromolecule organic transparent material), a thickness of the planarization layer is about 1.5 μm, and a thickness of the black matrix, color film layer, and color resist layer is 2 to 3 μm, then, based on the thicknesses value, after forming the convex-concave pattern, an original function of the film layer will not be affected.

In one embodiment, the plurality of support columns include a plurality of main support columns (Main ps) and a plurality of auxiliary support columns (Sub ps), and the contact film layer may form the same parameters (including size, shape and depth, etc.) convex-concave pattern, and also can form with different parameters (including size, shape, depth, etc.) convex-concave pattern. For example, a depth of the convex-concave pattern 15 formed when the contact film layer contacts the main support pillar is greater than a depth of the convex-concave pattern formed when the auxiliary pillar contacts the main support pillar.

The present disclosure further provides an electronic device, including the display panel provided by any of the foregoing embodiments.

In one embodiment, the electronic device includes a display panel comprising:

m GOA units arranged in a column direction, wherein each of the GOA units comprises a pull-up module, and the pull-up module comprises a clock input transistor connected to a clock signal;

n clock signal lines extending in the column direction and arranged in parallel; and m clock signal connection lines extending in a row direction and arranged in parallel, wherein the m clock signal connection lines are corresponding one-by-one with the m GOA units, and configured to connect the clock input transistor of the pull-up module of the GOA unit to the corresponding clock signal line;

wherein the n clock signal lines comprise a $n1^{st}$ clock signal line and a $n2^{nd}$ clock signal line, the $n2^{nd}$ clock signal line is formed on a side of the $n1^{st}$ clock signal line away from the GOA unit, and a voltage drop value of the clock input transistor of the pull-up module of a $m1^{st}$ GOA unit connected to the $n1^{st}$ clock signal line is greater than a voltage drop value of the clock input transistor of the pull-up module of a $m2^{nd}$ GOA unit connected to the $n2^{nd}$ clock signal line.

In one embodiment, in the electronic device of the present disclosure, a size of the clock input transistor of the pull-up module of the $m1^{st}$ GOA unit is greater than a size of the clock input transistor of the pull-up module of the $m2^{nd}$ GOA unit.

In one embodiment, in the electronic device of the present disclosure, the clock input transistor comprises a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit.

In one embodiment, in the electronic device of the present disclosure, a source area of the clock input transistor of the pull-up module of the $m1^{st}$ GOA unit is greater than a source area of the clock input transistor of the pull-up module of the $m2^{nd}$ GOA unit; and/or a drain area of the clock input transistor of the pull-up module of the $m1^{st}$ GOA unit is greater than a drain area of the clock input transistor of the pull-up module of the $m2^{nd}$ GOA unit.

In one embodiment, in the electronic device of the present disclosure, a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit.

In one embodiment, in the electronic device of the present disclosure, a $n^{th}$ level GOA unit of the m GOA units comprises:

a pull-up control module connected to a first node, and configured to raise an electrical potential of the first node during a display period;

a logical addressing module comprising a second node, wherein the logical addressing module is connected to the first node, configured to raise an electrical potential of the second node twice during the display period, and configured to raise the electrical potential of the first node through the second node during a blank period;

a pull-up module connected to the first node, and configured to raise electrical potentials of a $n^{th}$ level transmission signal, a first output signal, and a second output signal;

a first pull-down module connected to the first node, and configured to pull down the electrical potential of the first node during the blank period;

a second pull-down module connected to the first node and a third node, and configured to pull down electrical potentials of the first node and the third node respectively during the display period;

a third pull-down module connected to the third node and the second pull-down module, and configured to pull down the electrical potential of the third node during the blank period;

a first pull-down maintenance module comprising the third node, wherein the first pull-down maintenance module is connected to the first node and the first pull-down module, and configured to maintain the first node at a low electrical potential; and a second pull-down maintenance module connected to the third node and the pull-up module, and configured to maintain the $n^{th}$ level transmission signal, the first output signal, and the second output signal at the low electrical potential.

In one embodiment, in the electronic device of the present disclosure, the pull-up control module comprises a first transistor and a second transistor, a gate and a first electrode of the first transistor and a gate of the second transistor are connected to a $n-2^{th}$ level transmission signal, a second electrode of the first transistor is connected to a first electrode of the second transistor and a fourth node, and a second electrode of the second transistor is connected to the first node.

In one embodiment, in the electronic device of the present disclosure, a material resistivity of a source-drain layer of the clock input transistor of the pull-up module of the $m1^{st}$ GOA unit is greater than a material resistivity of a source-drain layer of the clock input transistor of the pull-up module of the $m2^{nd}$ GOA unit.

In one embodiment, in the electronic device of the present disclosure, a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit.

In one embodiment, in the electronic device of the present disclosure, a contact area between a drain and an active layer of the clock input transistor of the pull-up module of the $m1^{st}$ GOA unit is smaller than a contact area between a drain and an active layer of the clock input transistor of the pull-up module of the $m2^{nd}$ GOA unit.

According to the above embodiment, it is known that:

The present disclosure provides a display panel and an electronic device, the display panel comprising m GOA units arranged in a column direction, each of the GOA units comprises a pull-up module, the pull-up module comprises a clock input transistor connected to a clock signal; n clock signal lines extending in the column direction and arranged in parallel; and m clock signal connection lines extending in a row direction and arranged in parallel, the m clock signal connection lines corresponding one-to-one with the m GOA unit, configured to connect the clock input transistor of the pull-up module of the GOA unit to the corresponding clock signal line; wherein the n clock signal lines comprise $n1^{st}$ clock signal line and $n2^{nd}$ clock signal line, the $n2^{nd}$ clock signal line is formed on a side away from the GOA unit of the $n1^{st}$ clock signal line, a voltage drop value of the clock input transistor of pull-up module of $m1^{st}$ GOA unit connected to the $n1^{st}$ clock signal line is greater than a voltage drop value of the clock input transistor of pull-up module of $m2^{nd}$ GOA unit connected to the $n2^{nd}$ clock signal line. Based on this circuit structure, by adjusting the voltage drop values of the clock input transistors of different GOA units, the voltage drop values caused by the different lengths of the clock signal line and the clock signal connection line can be compensated. Thereby making the voltage drop value between each GOA unit and the clock driving chip are approximately the same, alleviating the CK impedance difference existing in 8K ultra-high resolution electronic device and improves the technical problems of 8K ultra-high resolution electronic devices that lead by the difference in the output signal of the GOA unit.

The display panel and the electronic device provided by the embodiments of the present disclosure have been described in detail above. Specific examples are used to explain the principles and implementation of the present disclosure. The descriptions of the above embodiments are only used to help understand technical solutions and their core ideast of the present disclosure. It can be understood that, for those of ordinary skill in the art, equivalent replacements or changes can be made according to the technical solutions and inventive concepts of the present disclosure, and all such changes or replacements should fall within the protection scope of the appended claims of the present disclosure.

What is claimed is:

1. A display panel, comprising:

m GOA units arranged in a column direction, wherein each of the GOA units comprises a pull-up module, and the pull-up module comprises a clock input transistor connected to a clock signal;

n clock signal lines extending in the column direction and arranged in parallel; and m clock signal connection lines extending in a row direction and arranged in parallel, wherein the m clock signal connection lines correspond one-by-one with the m GOA units, and are configured to connect the clock input transistor of the pull-up module of the GOA unit to the corresponding clock signal line;

wherein the n clock signal lines comprise an $n1^{st}$ clock signal line and an $n2^{nd}$ clock signal line, the $n2^{nd}$ clock signal line is formed on a side of the $n1^{st}$ clock signal line away from the GOA unit, and a voltage drop value of the clock input transistor of the pull-up module of an $m1^{st}$ GOA unit connected to the $n1^{st}$ clock signal line is greater than a voltage drop value of the clock input transistor of the pull-up module of an $m2^{nd}$ GOA unit connected to the $n2^{nd}$ clock signal line; and wherein a size of the clock input transistor of the pull-up module of the $m1^{st}$ GOA unit is greater than a size of the clock input transistor of the pull-up module of the $m2^{nd}$ GOA unit.

2. The display panel as claimed in claim 1, wherein the clock input transistor comprises a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit.

3. The display panel as claimed in claim 1, wherein a source area of the clock input transistor of the pull-up module of the $m1^{st}$ GOA unit is greater than a source area of the clock input transistor of the pull-up module of the $m2^{nd}$ GOA unit; and/or a drain area of the clock input transistor of the pull-up module of the $m1^{st}$ GOA unit is greater than a drain area of the clock input transistor of the pull-up module of the $m2^{nd}$ GOA unit.

4. The display panel as claimed in claim 1, wherein a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit.

5. The display panel as claimed in claim 1, wherein an $n^{th}$ level GOA unit of the m GOA units comprises:

a pull-up control module connected to a first node, and configured to raise an electrical potential of the first node during a display period;

a logical addressing module comprising a second node, wherein the logical addressing module is connected to the first node, configured to raise an electrical potential of the second node twice during the display period, and configured to raise the electrical potential of the first node through the second node during a blank period;

the pull-up module connected to the first node, and configured to raise electrical potentials of an nth level transmission signal, a first output signal, and a second output signal;

a first pull-down module connected to the first node, and configured to pull down the electrical potential of the first node during the blank period;

a second pull-down module connected to the first node and a third node, and configured to pull down electrical potentials of the first node and the third node respectively during the display period;

a third pull-down module connected to the third node and the second pull-down module, and configured to pull down the electrical potential of the third node during the blank period;

a first pull-down maintenance module comprising the third node, wherein the first pull-down maintenance module is connected to the first node and the first pull-down module, and configured to maintain the first node at a low electrical potential; and a second pull-down maintenance module connected to the third node and the pull-up module, and configured to maintain the nth level transmission signal, the first output signal, and the second output signal at the low electrical potential.

6. The display panel as claimed in claim 5, wherein the pull-up control module comprises a first transistor and a second transistor, a gate and a first electrode of the first transistor and a gate of the second transistor are connected to an $n-2^{th}$ level transmission signal, a second electrode of the first transistor is connected to a first electrode of the second transistor and a fourth node, and a second electrode of the second transistor is connected to the first node.

7. The display panel as claimed in claim 1, wherein a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit.

8. The display panel as claimed in claim 1, wherein a material resistivity of a source-drain layer of the clock input transistor of the pull-up module of the $m1^{st}$ GOA unit is greater than a material resistivity of a source-drain layer of the clock input transistor of the pull-up module of the $m2^{nd}$ GOA unit.

9. The display panel as claimed in claim 1, wherein a contact area between a drain and an active layer of the clock input transistor of the pull-up module of the $m1^{st}$ GOA unit is smaller than a contact area between a drain and an active layer of the clock input transistor of the pull-up module of the $m2^{nd}$ GOA unit.

10. An electronic device comprising a display panel, the display panel comprising:

m GOA units arranged in a column direction, wherein each of the GOA units comprises a pull-up module, and the pull-up module comprises a clock input transistor connected to a clock signal;

n clock signal lines extending in the column direction and arranged in parallel; and m clock signal connection lines extending in a row direction and arranged in parallel, wherein the m clock signal connection lines correspond one-by-one with the m GOA units, and are configured to connect the clock input transistor of the pull-up module of the GOA unit to the corresponding clock signal line;

wherein the n clock signal lines comprise an $n1^{st}$ clock signal line and an n2nd clock signal line, the n2nd clock signal line is formed on a side of the $n1^{st}$ clock signal line away from the GOA unit, and a voltage drop value of the clock input transistor of the pull-up module of an $m1^{st}$ GOA unit connected to the $n1^{st}$ clock signal line is greater than a voltage drop value of the clock input transistor of the pull-up module of an $m2^{nd}$ GOA unit connected to the $n2^{nd}$ clock signal line; and wherein a size of the clock input transistor of the pull-up module of the m1st GOA unit is greater than a size of the clock input transistor of the pull-up module of the $m2^{nd}$ GOA unit.

11. The electronic device as claimed in claim 10, wherein the clock input transistor comprises a plurality of sub-transistors connected in an array, and a number of the sub-transistors of the clock input transistor of the pull-up module of the $m1^{st}$ GOA unit is greater than a number of the sub-transistors of the clock input transistor of the pull-up module of the $m2^{nd}$ GOA unit.

12. The electronic device as claimed in claim 10, wherein a source area of the clock input transistor of the pull-up module of the $m1^{st}$ GOA unit is greater than a source area of the clock input transistor of the pull-up module of the $m2^{nd}$ GOA unit; and/or a drain area of the clock input transistor of the pull-up module of the $m1^{st}$ GOA unit is greater than a drain area of the clock input transistor of the pull-up module of the $m2^{nd}$ GOA unit.

13. The electronic device as claimed in claim 10, wherein a contact area between a source and an active layer of the clock input transistor of the pull-up module of the $m1^{st}$ GOA unit is smaller than a contact area between a source and an active layer of the clock input transistor of the pull-up module of the $m2^{nd}$ GOA unit.

14. The electronic device as claimed in claim 10, wherein an $n^{th}$ level GOA unit of the m GOA units comprises:

a pull-up control module connected to a first node, and configured to raise an electrical potential of the first node during a display period;

a logical addressing module comprising a second node, wherein the logical addressing module is connected to the first node, configured to raise an electrical potential of the second node twice during the display period, and configured to raise the electrical potential of the first node through the second node during a blank period;

the pull-up module connected to the first node, and configured to raise electrical potentials of an nth level transmission signal, a first output signal, and a second output signal;

a first pull-down module connected to the first node, and configured to pull down the electrical potential of the first node during the blank period;

a second pull-down module connected to the first node and a third node, and configured to pull down electrical potentials of the first node and the third node respectively during the display period;

a third pull-down module connected to the third node and the second pull-down module, and configured to pull down the electrical potential of the third node during the blank period;

a first pull-down maintenance module comprising the third node, wherein the first pull-down maintenance module is connected to the first node and the first pull-down module, and configured to maintain the first node at a low electrical potential; and a second pull-down maintenance module connected to the third node and the pull-up module, and configured to maintain the nth level transmission signal, the first output signal, and the second output signal at the low electrical potential.

15. The electronic device as claimed in claim 14, wherein the pull-up control module comprises a first transistor and a second transistor, a gate and a first electrode of the first transistor and a gate of the second transistor are connected to an $n-2^{th}$ level transmission signal, a second electrode of the first transistor is connected to a first electrode of the second transistor and a fourth node, and a second electrode of the second transistor is connected to the first node.

16. The electronic device as claimed in claim 10, wherein a material resistivity of a source-drain layer of the clock input transistor of the pull-up module of the mist GOA unit is greater than a material resistivity of a source-drain layer of the clock input transistor of the pull-up module of the $m2^{nd}$ GOA unit.

17. The electronic device as claimed in claim 10, wherein a thickness of a source-drain layer of the clock input transistor of the pull-up module of the $m1^{st}$ GOA unit is less than a thickness of a source-drain layer of the clock input transistor of the pull-up module of the $m2^{nd}$ GOA unit.

18. The electronic device as claimed in claim 10, wherein a contact area between a drain and an active layer of the clock input transistor of the pull-up module of the $m1^{st}$ GOA unit is smaller than a contact area between a drain and an active layer of the clock input transistor of the pull-up module of the $m2^{nd}$ GOA unit.

* * * * *